US010926382B2

(12) United States Patent
Hu

(10) Patent No.: US 10,926,382 B2
(45) **Date of Patent: *Feb. 23, 2021**

(54) ELECTRIC RATCHET WRENCH

(71) Applicant: Bobby Hu, Taichung (TW)

(72) Inventor: Bobby Hu, Taichung (TW)

(73) Assignee: Bobby Hu, Taichung (TW)

( * ) Notice: Subject to any disclaimer, the term of this patent is extended or adjusted under 35 U.S.C. 154(b) by 510 days.

This patent is subject to a terminal disclaimer.

(21) Appl. No.: 14/882,510

(22) Filed: Oct. 14, 2015

(65) Prior Publication Data

US 2017/0057061 A1 Mar. 2, 2017

(30) Foreign Application Priority Data

Sep. 1, 2015 (TW) ..... 104128842

(51) Int. Cl.
*B25B 13/46* (2006.01)
*B25B 21/00* (2006.01)
(Continued)

(52) U.S. Cl.
CPC ..... *B25B 21/004* (2013.01); *B25B 13/465* (2013.01); *B25B 13/467* (2013.01);
(Continued)

(58) Field of Classification Search
CPC ... B25B 21/004; B25B 13/465; B25B 13/467; B25B 23/141; B25B 23/142;
(Continued)

(56) References Cited

U.S. PATENT DOCUMENTS 1,352,354 A * 9/1920 Church ..... B25B 13/467 81/177.1
2,176,928 A * 10/1939 Short ..... B25B 23/141 81/475

(Continued)

FOREIGN PATENT DOCUMENTS

CN 201020685 Y 2/2008
CN 201632960 U 11/2010

(Continued)

OTHER PUBLICATIONS

German Office Action based on Application No. 10 2015 118 300.5; dated Feb. 20, 2020; 7 pages (for reference purpose only).

*Primary Examiner* — Joseph J Hail
*Assistant Examiner* — Arman Milanian
(74) *Attorney, Agent, or Firm* — Viering, Jentschura & Partner MBB

(57) ABSTRACT

An electric ratchet wrench includes a body receiving a driving device for driving a fastener. A first transmission device is connected to the driving device. A second transmission device is connected to a power device. A clutch device is mounted between the first and second transmission devices and is normally in a coupling state for driving the fastener. When the clutch device switches to the disengagement state due to a resistance larger than a torque outputted by the power device, the body can be manually driven to overcome the resistance, forcibly driving the fastener through the large-resistance position. The clutch device returns to the coupling state after the fastener passes the large-resistance position.

20 Claims, 18 Drawing Sheets

(51) Int. Cl.
*B25B 23/14* (2006.01)
*B25B 23/142* (2006.01)
*B25B 23/147* (2006.01)

(52) U.S. Cl.
CPC ..... *B25B 23/141* (2013.01); *B25B 23/142* (2013.01); *B25B 23/147* (2013.01); *B25B 23/1427* (2013.01)

(58) Field of Classification Search
CPC ..... B25B 23/1427; B25B 23/147; A61B 2090/031; F16D 7/06
USPC ..... 81/469, 473, 474, 475, 467
See application file for complete search history.

(56) References Cited

U.S. PATENT DOCUMENTS 2,179,724 A * 11/1939 Kuehne ..... B25B 21/00 192/48.1
2,442,359 A * 6/1948 Hattan ..... B25B 23/1427 200/52 R
2,614,418 A * 10/1952 Shaff ..... B25B 21/00 73/862.21
2,621,767 A 12/1952 McDevitt
2,966,247 A * 12/1960 Bryer ..... F16D 43/202 192/56.53
3,487,902 A * 1/1970 Nissmo ..... F16D 7/06 192/56.1
3,567,010 A * 3/1971 Vom Stein ..... B65G 13/073 198/790
3,707,893 A 1/1973 Hofman
3,756,090 A 9/1973 Mella et al.
4,023,744 A 5/1977 Shutt
4,062,203 A * 12/1977 Leonard ..... B25B 23/141 464/38
4,517,865 A * 5/1985 Huang ..... B25B 23/142 81/475
4,524,649 A 6/1985 Diaz et al.
4,566,570 A * 1/1986 Geisthoff ..... F16D 7/048 192/56.1
4,653,359 A * 3/1987 Liao ..... B25B 23/147 81/475
4,951,756 A * 8/1990 Everett ..... B25B 23/145 173/178
5,058,463 A * 10/1991 Wannop ..... B25B 13/467 81/57.26
5,201,374 A * 4/1993 Rahm ..... B25B 23/145 173/176
5,305,670 A 4/1994 Fossella et al.
5,709,136 A 1/1998 Frenkel
6,047,616 A * 4/2000 Ochiai ..... B25B 13/467 81/57.13
6,062,939 A 5/2000 Parker et al.
6,070,499 A * 6/2000 Wisbey ..... B25B 13/467 81/57.29
6,209,422 B1 4/2001 Kamiya et al.
6,216,562 B1 4/2001 Hsieh
6,457,386 B1 * 10/2002 Chiang ..... B25B 13/465 81/57.29
6,568,298 B1 5/2003 Zinck
7,069,818 B1 * 7/2006 Huang ..... B25B 13/465 81/57.29
7,104,165 B2 9/2006 Chu
7,171,874 B1 * 2/2007 Huang ..... B25B 13/461 403/329
7,181,996 B1 * 2/2007 Chu ..... B25B 13/465 81/57.29
7,267,033 B1 * 9/2007 Lai ..... B25B 13/465 81/57.29
7,406,900 B1 * 8/2008 Hsieh ..... B25B 23/1427 81/475
7,444,902 B1 * 11/2008 Lin ..... B25B 13/465 81/57.29
7,571,668 B1 8/2009 Chang
7,628,098 B2 * 12/2009 Kimberly ..... B25B 21/00 81/57.13
7,938,042 B2 * 5/2011 Hu ..... B25B 13/465 81/62
8,495,935 B2 * 7/2013 Mountz ..... G01L 5/24 81/467
8,800,410 B1 8/2014 Huang
9,038,505 B2 * 5/2015 He ..... B25B 17/00 81/57.29
9,061,404 B2 * 6/2015 Dohogne ..... B25B 13/467
9,120,213 B2 * 9/2015 Elger ..... B25B 21/004
9,999,964 B2 * 6/2018 Hu ..... B25B 13/465
2003/0144615 A1 * 7/2003 Lin ..... A61H 33/6057 601/112
2004/0226411 A1 * 11/2004 Hsien ..... B25B 13/463 81/57.13
2005/0204876 A1 * 9/2005 Chen ..... B25B 15/02 81/473
2006/0060032 A1 3/2006 Baker
2007/0084310 A1 4/2007 Kobayashi
2008/0271574 A1 11/2008 Lin et al.
2009/0114058 A1 5/2009 Malone
2009/0114068 A1 5/2009 Lawrence
2013/0228053 A1 * 9/2013 Chen ..... B25B 23/1427 81/467
2014/0157961 A1 6/2014 Chen
2016/0075002 A1 3/2016 Hu et al.
2016/0075003 A1 * 3/2016 Hu ..... B25B 21/004 81/57.13
2016/0339567 A1 11/2016 Hu
2016/0339568 A1 11/2016 Hu

FOREIGN PATENT DOCUMENTS

CN 203592442 U 5/2014
CN 103962996 A 8/2014
DE 3303732 A1 * 8/1984 ..... F16D 7/06
DE 20309684 U1 9/2003
EP 2998069 B1 3/2016
EP 3100825 A1 12/2016
EP 2995425 B1 8/2017
JP S62136378 A 6/1987
JP H0531873 U 4/1993
JP H0624867 U 4/1994
TW M290086 U 5/2006
TW 200838649 A 10/2008
TW I318912 B 1/2010
TW I319733 B 1/2010
TW M377293 U 4/2010
TW M413569 U 10/2011
TW M449063 U 3/2013
WO WO2008018221 A1 2/2008

* cited by examiner

ELECTRIC RATCHET WRENCH

BACKGROUND

The present invention relates to a ratchet wrench and, more particularly, to an electric ratchet wrench.

U.S. Pat. No. 8,800,410 discloses a ratchet wrench with a direction switching structure. The ratchet wrench includes a wrench body, a ratchet wheel, a ratcheting member, and a switching member. The ratchet wheel is rotatably mounted in the wrench body and can couple with a socket. The ratcheting member is mounted in the wrench body and is selectively engaged with the ratchet wheel by using a left half portion or a right half portion of ratchet teeth of the ratcheting member to switch the rotating direction of the ratchet wheel. The switching member is pivotably mounted in the body and abuts the ratcheting member.

A user has to grip the wrench body and rotate the wrench body in opposite directions to drive the socket in a single direction. Long bolts are commonly used in a building construction site. Considerable time is required for repeated operations of the long bolts in opposite directions. Furthermore, the long bolts are apt to rust in outdoor building construction sites, and the user has to spend time and effort to tighten or loosen the rusted long bolts with conventional ratchet wrenches.

Thus, a need exists for a novel electric ratchet wrench to mitigate and/or obviate the above disadvantages.

BRIEF SUMMARY

This need and other problems in the field of easy driving of ratchet wrenches are solved by an electric ratchet wrench including a body having first and second ends. A driving device is mounted to the first end of the body. The driving device is adapted to drive a fastener. A power device is mounted to the second end of the body. The power device is adapted to provide electricity for operation. A first transmission device is mounted between the driving device and the power device. The first transmission device is rotatably received in the body and is connected to the driving device. A second transmission device is mounted between the driving device and the power device. The second transmission device is rotatably mounted in the body and is connected to the power device. A clutch device is mounted between the first transmission device and the second transmission device. The clutch device is switchable between a coupling state and a disengagement state.

When a resistance smaller than a torque outputted by the power device is encountered while the driving device is driving a fastener, the clutch device is in the coupling state, the power device drives the second transmission device and the clutch device to drive the first transmission device to rotate, and the driving device is rotated to continuously drive the fastener.

When a large resistance larger than the torque outputted by the power device is encountered at a position while the driving device is driving the fastener, the clutch device is in the disengagement state, the torque of the power device is not permitted to be transmitted through the second transmission device to the first transmission device, the body is permitted to be manually rotated to overcome the large resistance and to forcibly drive the fastener through the position via the driving device, and the clutch device returns to the coupling state after the fastener passes through the position.

The clutch device can include a first clutch member mounted to the first transmission device and a second clutch member mounted to the second transmission device. The first clutch member and the second clutch member disengageably engage with each other. The first clutch member and the second clutch member engage with each other when the clutch device is in the coupling state. The first clutch member and the second clutch member are in a semi-coupling state repeatedly engaging with and disengaging from each other when the clutch device is in the disengagement state.

The first clutch member can include at least one first clutch portion. The second clutch member can include at least one second clutch portion. The at least one first clutch portion and the at least one second clutch portion disengageably engage with each other.

The first transmission device can include a first transmission member having a first connection end, a second connection end, and a body portion between the first and second connection ends. The first connection end is connected to the driving device. The first clutch member is slideably mounted on the second connection end.

The second transmission device can include a second transmission member having a first coupling end, a second coupling end, and a coupling section between the first and second coupling ends. The second clutch member is slideably mounted on the first coupling end. The second coupling end is connected to the power device.

In an example, the first clutch member further includes a connection portion on an end face of the first clutch member opposite to the first transmission member. The at least one first clutch portion is provided on an inner periphery of the connection portion. The second clutch member is rotatably connected to the connection portion of the first clutch member. The second clutch member includes a through-hole. The at least one second clutch portion is slideably received in the through-hole and disengageably engages with the at least one first clutch portion.

The clutch device can further include an elastic element abutting one of the first clutch member and the second clutch member. When the large resistance larger than the torque outputted by the power device is encountered at the position while the driving device is driving the fastener, the clutch device is in the disengagement state, the first clutch member and the second clutch member repeatedly engage with and disengage from each other, and the one of the first clutch member and the second clutch member compresses the elastic element. The body is permitted to be manually rotated to overcome the large resistance and to forcibly drive the fastener through the position via the driving device. The clutch device returns to the coupling state under action of the elastic element after the fastener passes through the position.

The body can further include a compartment located in the second end of the body and a connection hole in communication with the compartment. The power device is received in the compartment. The first transmission device and the clutch device are rotatably mounted in the connection hole. The second transmission device is rotatably mounted in the compartment.

The connection hole can include a first section having a first inner diameter and a second section in communication with the first section and the compartment and having a second inner diameter larger than the first inner diameter. The first transmission device is rotatably mounted in the first section. The clutch device is rotatably mounted in the second section. The second transmission device is rotatably mounted between the compartment and the second section of the connection hole.

The driving device can include a driving member rotatably mounted in the first end of the body and a first ring gear rotatably mounted to the driving member for driving the driving member to rotate. The first ring gear includes a side toothed portion on an end face thereof. The first transmission member includes a gear meshed with the side toothed portion of the first ring gear.

The body can further include a driving hole having an inner periphery with a toothed portion. The driving device can further include a second ring gear, a pawl device, and a direction switching device. The second gear ring is rotatably mounted to the driving member and is spaced from the first ring gear. The first ring gear further includes an inner toothed portion on an inner periphery thereof. The second ring gear includes a side toothed portion on an end face thereof and an inner toothed portion on an inner periphery thereof. The inner toothed portions of the first and second ring gears selectively engage with the pawl device. The side toothed portion of the second ring gear meshes with the gear of the first transmission member. The pawl device includes two primary pawls, a first secondary pawl, and a second secondary pawl. Each of the two primary pawls is configured to selectively mesh with the toothed portion of the body. The first secondary pawl is configured to selectively mesh with the inner toothed portion of the first ring gear. The second secondary pawl is configured to selectively mesh with the inner toothed portion of the second ring gear. The direction switching device includes a direction switching rod extending through the driving member. The direction switching rod is pivotable relative to the driving member between two positions respectively corresponding to a driving direction and a non-driving direction. When the direction switching rod pivots between the two positions, an engagement status between each of the two primary pawls and the toothed portion of the body and an engagement status between the first and second secondary pawls and the first and second ring gears are changed to provide a direction switching function.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
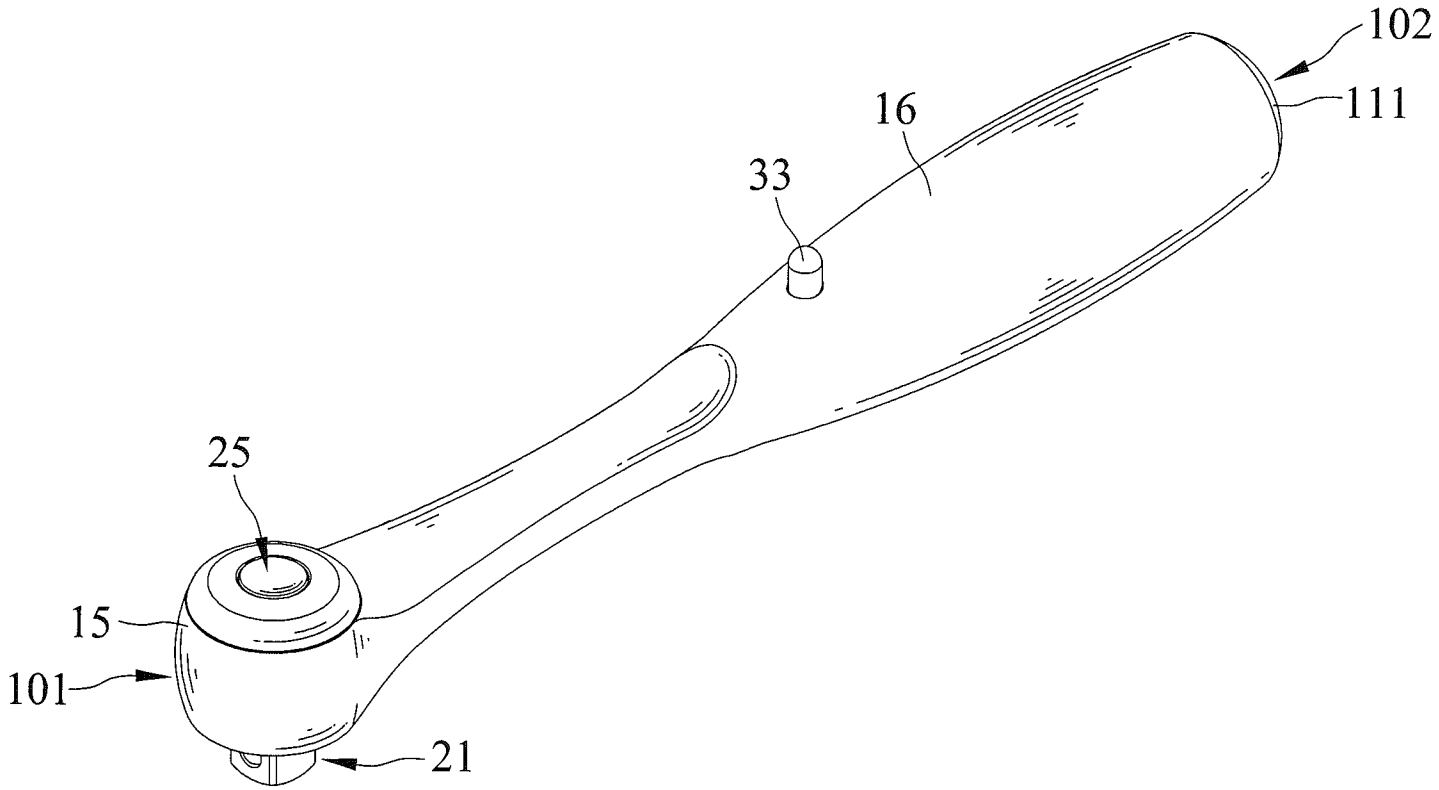
FIG. 1 is a perspective view of an electric ratchet wrench of a first embodiment according to the present invention.
Figure 2:
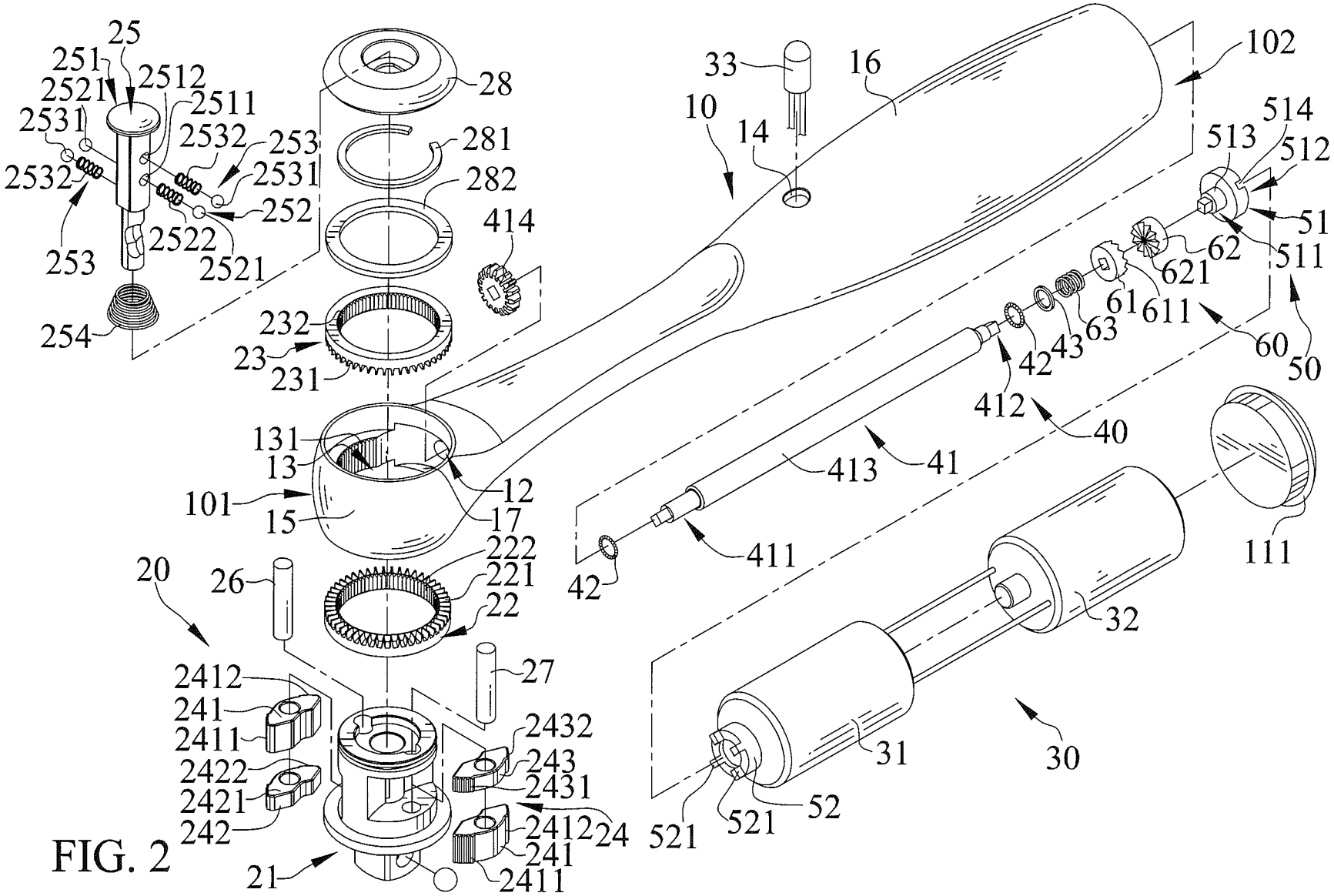
FIG. 2 is an exploded, perspective view of the electric ratchet wrench of FIG. 1.
Figure 3:
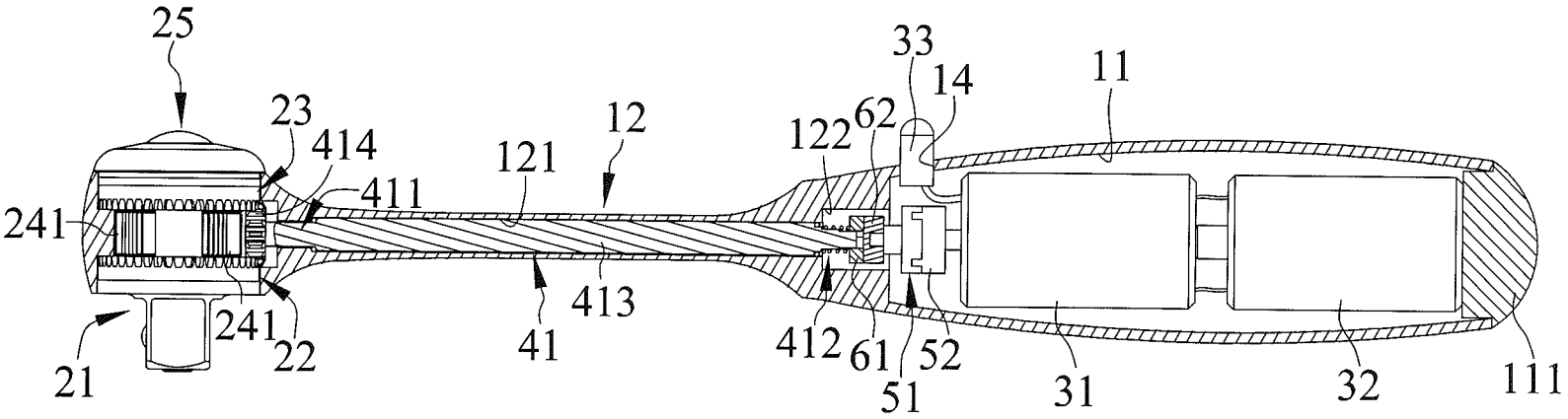
FIG. 3 is a cross-sectional view of the electric ratchet wrench of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "bottom", "side", "end", "portion", "section", "spacing", "length", "depth", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION

FIGS. 1-6 show an electric ratchet wrench of a first embodiment according to the present invention. The electric ratchet wrench includes a body 10, a driving device 20, a power device 30, a first transmission device 40, a second transmission device 50, and a clutch device 60. Body 10 includes a first end 101 and a second end 102 spaced from first end 101 along a first axis. Driving device 20 is mounted to first end 101 of body 10 and includes a driving member 21. Driving member 21 can couple with a socket or an extension rod for driving a faster, such as a bolt, a nut, etc. Power device 30 is mounted to second end 102 of body 10 and is adapted to provide electricity for operation. First transmission device 40 is mounted between driving device 20 and power device 30, is rotatably received in body 10, and is connected to driving device 20. Second transmission device 50 is mounted between driving device 20 and power device 30, is rotatably mounted in body 10, and is connected to power device 30. Clutch device 60 is mounted between first transmission device 40 and second transmission device 50 and is switchable between a coupling state and a disengagement state.

When a resistance smaller than a torque outputted by power device 30 is encountered while driving member 21 is driving a fastener, clutch device 60 is in the coupling state, power device 30 drives second transmission device 50 and clutch device 60 to drive first transmission device 40 to rotate, and driving device 20 is rotated to continuously and rapidly drive the fastener.

When a large resistance larger than the torque outputted by power device 30 is encountered at a position while driving device 20 is driving the fastener, clutch device 60 is in the disengagement state, the torque of power device 30 is not permitted to be transmitted through second transmission device 50 to first transmission device 40, body 10 is permitted to be manually rotated to overcome the large resistance and to forcibly drive the fastener through the position via driving device 20, and clutch device 60 returns to the coupling state after the fastener passes through the position.

Clutch device 60 includes a first clutch member 61 mounted to first transmission device 40 and a second clutch member 62 mounted to second transmission device 50. First and second clutch members 61 and 62 disengageably engage with each other. First and second clutch members 61 and 62 engage with each other when clutch device 60 is in the coupling state. First and second clutch members 61 and 62 are in a semi-coupling state repeatedly engaging with and disengaging from each other when clutch device 60 is in the disengagement state.

First clutch member 61 includes at least one first clutch portion 611. Second clutch member 62 includes at least one second clutch portion 621. The at least one first clutch portion 611 and the at least one second clutch portion 621 disengageably engage with each other.

In this embodiment, first clutch member 61 includes a plurality of first clutch portions 611 formed on an end face of first clutch member 61, and second clutch member 62 includes a plurality of second clutch portions 621 formed on an end face of second clutch member 62. First and second clutch portions 611 and 621 are mutually engageable teeth.

When clutch device 60 is in the coupling state, first and second clutch portions 611 and 621 mesh with each other. When clutch device 60 is in the disengagement state, first and second clutch portions 611 and 621 are in the semi-coupling state repeatedly engaging with and disengaging from each other.

First transmission device 40 includes a first transmission member 41 having a first connection end 411, a second connection end 412, and a body portion 413 between the first and second connection ends 411 and 412. First connection end 411 is connected to driving device 20. First clutch member 61 is slideably mounted on second connection end 412.

Clutch device 60 further includes an elastic element 63 abutting one of first and second clutch members 61 and 62. In this embodiment, elastic element 63 is a coil spring mounted around second connection end 412 and located between and abutting body portion 413 and first clutch member 61. When a large resistance larger than the torque outputted by power device 30 is encountered at the position while driving device 20 is driving the fastener, clutch device 60 is in the disengagement state, first and second clutch members 61 and 62 are in a semi-coupling state repeatedly engaging with and disengaging from each other, such that first transmission member 41 cannot rotate and such that one of first and second clutch members 62 compresses elastic element 63. In this case, body 10 is permitted to be manually rotated to overcome the large resistance and to forcibly drive the fastener through the position via driving device 20, and clutch device 60 returns to the coupling state under action of elastic element 63 after the fastener passes through the position.

In this embodiment, second connection end 412 of first transmission member 41 includes a first section 4121 and a second section 4122 located between first section 4121 and body portion 413. First clutch member 61 is slideably mounted around first section 4121. An outer diameter D2 of second section 4122 is larger than an outer diameter D1 of first section 4121. First clutch member 61 can abut against second section 4122. Thus, when clutch device 60 is in the disengagement state in which first and second clutch members 61 and 62 are in a semi-coupling state repeatedly engaging with and disengaging from each other, first clutch member 61 slides relative to first section 4121 of second connection end 412. Second section 4122 provides a stopper function for first clutch member 61.

Second transmission device 50 includes a second transmission member 51 and a connecting member 52. Second transmission member 51 includes a first coupling end 511, a second coupling end 512, and a coupling section 513 between first and second coupling ends 511 and 512. Second clutch member 62 is mounted on first coupling end 511. Second coupling end 512 is connected to connecting member 52. An end of connecting member 52 opposite to second transmission member 51 is connected to power device 30.

Power device 30 includes a motor 31 having a motor shaft 311. Motor 31 can be driven by electricity to drive motor shaft 311. An end of motor shaft 311 is connected to connecting member 52. Second transmission member 51 includes at least one first shaft coupling portion 514 in the form of a recess in second coupling end 512 of second transmission member 51. The at least one first shaft coupling portion 514 has a first coupling tooth height W1. In this embodiment, second transmission member 51 includes four first shaft coupling portions 514. Connecting member 52 includes at least one second shaft coupling portion 521 in the form of a protrusion on an end of connecting member 52 opposite to motor shaft 311 and aligned with the at least one first shaft coupling portion 514. The at least one second shaft coupling portion 521 is connected to the at least one first shaft coupling portion 514 and has a second coupling tooth height W2 equal to the first coupling tooth height W1. In this embodiment, the connecting member 52 includes four second shaft coupling portions 521. First clutch portion 611 of first clutch member 61 has a first clutch tooth height H1 smaller than first coupling tooth height W1. Second clutch portion 621 of second clutch member 62 has a second clutch tooth height H2 equal to first clutch tooth height H1.

In this embodiment, when clutch device 60 is in the coupling state, a first spacing G1 exists between first clutch member 61 and second section 4122 of second connection end 412 of first transmission member 41. First coupling tooth height W1 of the at least one first shaft coupling portion 514 is larger than a difference between first spacing G1 and first clutch tooth height H1. Thus, when clutch device 60 is in the disengagement state, the connection between connecting member 52, second transmission member 51, and second clutch member 62 is maintained to avoid disconnection.

Body 10 further includes a compartment 11 located in second end 102 of body 10 and a connection hole 12 in communication with compartment 11. Motor 31 of power device 30 is received in compartment 11. First transmission device 40 and clutch device 60 are rotatably mounted in connection hole 12. Second transmission device 50 is rotatably mounted in compartment 11.

In this embodiment, connection hole 12 includes a first section 121 having a first inner diameter B1 and a second section 122 in communication with first section 121 and compartment 11 and having a second inner diameter B2 larger than first inner diameter B1. First transmission device 40 is rotatably mounted in first section 121 of connection hole 12. Clutch device 60 is rotatably mounted in second section 122 of connection hole 12 without in direct contact with motor 31. Since second inner diameter B2 is larger than first inner diameter B1, clutch device 60 can include first and second clutch members 61 and 62 of larger diameters to increase the structural strength while increasing the contact area between first and second clutch members 61 and 62, effectively withstanding the bending force resulting from the large resistance larger than the torque outputted by motor 31.

Driving device 20 includes a driving member 21 rotatably mounted in first end 101 of body 10 and a first ring gear 22 rotatably mounted to driving member 21 for driving the driving member 21 to rotate. First ring gear 22 includes a side toothed portion 221 on an end face thereof. First transmission member 41 includes a gear 414 meshed with side toothed portion 221 of first ring gear 22. When clutch device 60 is in the coupling state, motor 31 drives connecting member 52, second transmission member 51, clutch device 60, and first transmission member 41. Gear 414 of first transmission member 41 drives first ring gear 22 to rotate, which, in turn, drives driving member 21 to rapidly rotate the fastener.

First end 101 of body 10 includes a driving hole 13 having an inner periphery with a toothed portion 131. Driving device 20 further includes a second ring gear 23, a pawl device 24, and a direction switching device 25. Second gear ring 23 is rotatably mounted to driving member 21 and is spaced from first ring gear 22 along a second axis perpendicular to the first axis. First ring gear 22 further includes an inner toothed portion 222 on an inner periphery thereof. Second ring gear 23 includes a side toothed portion 231 on an end face thereof and an inner toothed portion 232 on an inner periphery thereof. Inner toothed portions 222 and 232 of first and second ring gears 22 and 23 selectively engage with pawl device 24. Side toothed portion 231 of second ring gear 23 meshes with gear 414 of first transmission member 41. Pawl device 24 includes two primary pawls 241, a first secondary pawl 242, and a second secondary pawl 243. Each of the two primary pawls 241 is configured to selectively mesh with toothed portion 131 of body 10. First secondary pawl 242 is configured to selectively mesh with inner toothed portion 222 of first ring gear 22. Second secondary pawl 243 is configured to selectively mesh with inner toothed portion 232 of second ring gear 23.

Direction switching device 25 includes a direction switching rod 251 extending through the driving member 21. Direction switching rod 251 is pivotable relative to the driving member 21 between two positions respectively corresponding to a driving direction and a non-driving direction. When the direction switching rod 251 pivots between the two positions, an engagement status between each of the two primary pawls 241 and toothed portion 131 of body 10 and an engagement status between first and second secondary pawls 242 and 243 and first and second ring gears 22 and 23 are changed to provide a direction switching function.

Each of the two primary pawls 241 includes first and second primary toothed sections 2411 and 2412 respectively located on opposite ends of a side of primary pawl 241 facing away from driving member 21. First and second primary toothed sections 2411 and 2412 are configured to selectively mesh with toothed portion 131. First secondary pawl 242 includes first and second secondary toothed sections 2421 and 2422 respectively located on opposite ends of a side of first secondary pawl 242 facing away from driving member 21. First and second secondary toothed sections 2421 and 2422 are configured to selectively engage with inner toothed portion 222 of first ring gear 22 for joint rotation. Second secondary pawl 243 includes third and fourth secondary toothed sections 2431 and 2432 respectively located on opposite ends of a side of second secondary pawl 243 facing away from driving member 21. Third and fourth secondary toothed sections 2431 and 2432 are configured to selectively engage with inner toothed portion 232 of second ring gear 23 for joint rotation.

A first pin 26 extends through driving member 21, one of the two primary pawls 241, and first secondary pawl 242, such that the one of the two primary pawls 241 and first secondary pawl 242 are jointly pivotable about a third axis defined by first pin 26 and parallel to the second axis. A second pin 27 extends through driving member 21, the other primary pawl 241, and second secondary pawl 243, such that the other primary pawl 241 and second secondary pawl 243 are jointly pivotable relative to driving member 21 about a fourth axis defined by second pin 27 and parallel to the second axis. In this embodiment, primary pawls 241 are located on the same level along the second axis. First secondary pawl 242 and second secondary pawl 243 are opposed to each other in a diametric direction perpendicular to the second axis and are located on different levels along the second axis. Primary pawls 241 are located between first and second secondary pawls 242 and 243 along the second axis.

Direction switching rod 251 includes a through-hole 2511 extending in a diametric direction perpendicular to the second axis. Direction switching rod 251 further includes first and second receptacles 2512. Through-hole 2511 of direction switching rod 251 is located between first and second receptacles 2512 along the second axis. Each of first and second receptacles 2512 has an opening. The openings of first and second receptacles 2512 face away from each other and are diametrically opposed to each other.

Direction switching device 25 further includes a primary pressing unit 252 and two secondary pressing units 253. Primary pressing unit 252 is mounted in through-hole 2511 of direction switching rod 251 and includes two first pressing members 2521 and a first biasing element 2522 mounted between the two first pressing members 2521 and biasing the two first pressing members 2521 to respectively press against the two primary pawls 241. Each of the two secondary pressing units 253 includes a second pressing member 2531 and a second biasing element 2532. One of the two secondary pressing units 253 is mounted in first receptacle 2512 of direction switching rod 251. The second biasing element 2532 received in first receptacle 2512 biases the second pressing member 2531 received in first receptacle 2512 to press against first secondary pawl 242. The other secondary pressing unit 253 is mounted in second receptacle 2512 of direction switching rod 251. The second biasing member 2532 received in second receptacle 2512 biases the second pressing member 2531 received in second receptacle 2512 to press against second secondary pawl 243.

By such an arrangement, the user can switch direction switching rod 251 between the two positions to change the pressing directions of the two first pressing members 2521 of primary pressing unit 252 against the two primary pawls 241 and the pressing directions of second pressing members 2531 of the two secondary pressing units 253 against first and second secondary pawls 242 and 243, achieving the direction switching function.

When direction switching rod 251 is in one of the two positions, first primary toothed section 2411 of one of the two primary pawls 241 and second primary toothed section 2412 of the other primary pawl 241 mesh with toothed portion 131. On the other hand, when direction switching rod 251 is in the other position, second primary toothed section 2412 of the one of the two primary pawls 241 and first primary toothed section 2411 of the other primary pawl 241 mesh with toothed portion 131. Second secondary toothed section 2422 of first secondary pawl 242 meshes with inner toothed portion 232 of first ring gear 23. Third secondary toothed section 2431 of second secondary pawl 243 meshes with inner toothed portion 232 of second ring gear 23.

Driving device 20 further includes a cover 28 having substantially circular cross sections. Cover 28 is mounted to first end 101 of body 10 and seals a side of driving hole 13. Direction switching device 25 further includes a returning member 254 in the form of a coil spring having a small diameter end and a large diameter end. Returning member 254 is mounted around direction switching rod 251 with the small diameter end abutting cover 28 and with the large diameter end abutting direction switching rod 251, such that direction switching rod 251 can move relative to driving member 21 along the second axis between an initial position and a disengagement position. In this embodiment, driving member 21 can couple with a socket for driving a fastener when direction switching rod 251 is in the initial position, and the socket cannot be disengaged from driving member 21. On the other hand, when direction switching rod 251 is moved to the disengagement position, the socket can be disengaged from driving member 21, and return member 254 is compressed. Return member 254 provides a returning force for returning direction switching rod 251 from the disengagement position to the initial position. Thus, direction switching rod 251 is normally in the initial position. It can be appreciated that driving member 21 can directly or indirectly couple with a fastener by other arrangements.

A cap 111 can be mounted to an end of compartment 11 opposite to connection hole 12 to prevent dirt and dust from entering compartment 11, assuring operation of power device 30. Body 10 further includes a through-hole 14 extending in a radial direction perpendicular to the first axis. Through-hole 14 intercommunicates with compartment 11. Power device 30 is received in compartment 11 of body 10 and further includes a power source 32 and a control button 33. Power device 32 is electrically connected to motor 31 to supply power to motor 31. Control button 33 is mounted in through-hole 14 of body 10 and is electrically connected to motor 31 to control operation of motor 31.

Body 10 further includes a head 15, a handle 16, and a transmission groove 17. Head 15 is located on first end 101 of body 10 and includes driving hole 13. Handle 16 is located on second end 102 of body 10 and includes compartment 11. Two opposite ends of transmission groove 17 are respectively in communication with driving hole 13 and first section 121 of connection hole 12. In this embodiment, transmission groove 17 is crescent in cross section. Gear 414 of first transmission member 41 is rotatably received in transmission groove 17. Driving device 20 further includes a retaining member 281 and an abutment ring 282. Retaining member 281 is mounted in driving hole 13 to position cover 28, preventing disengagement of cover 28. In this embodiment, retaining member 281 is in the form of a C-clip. Abutment ring 282 is mounted between cover 28 and second ring gear 23 and abuts retaining member 281.

In this embodiment, first transmission device 40 further includes two bearings 42 and a ring 43. Bearings 42 are mounted on first and second connection ends 411 and 412 of first transmission member 41, respectively. Ring 43 is mounted on second connection end 412 of first transmission device 41 and abuts one of the two bearings 42.

Figure 4:
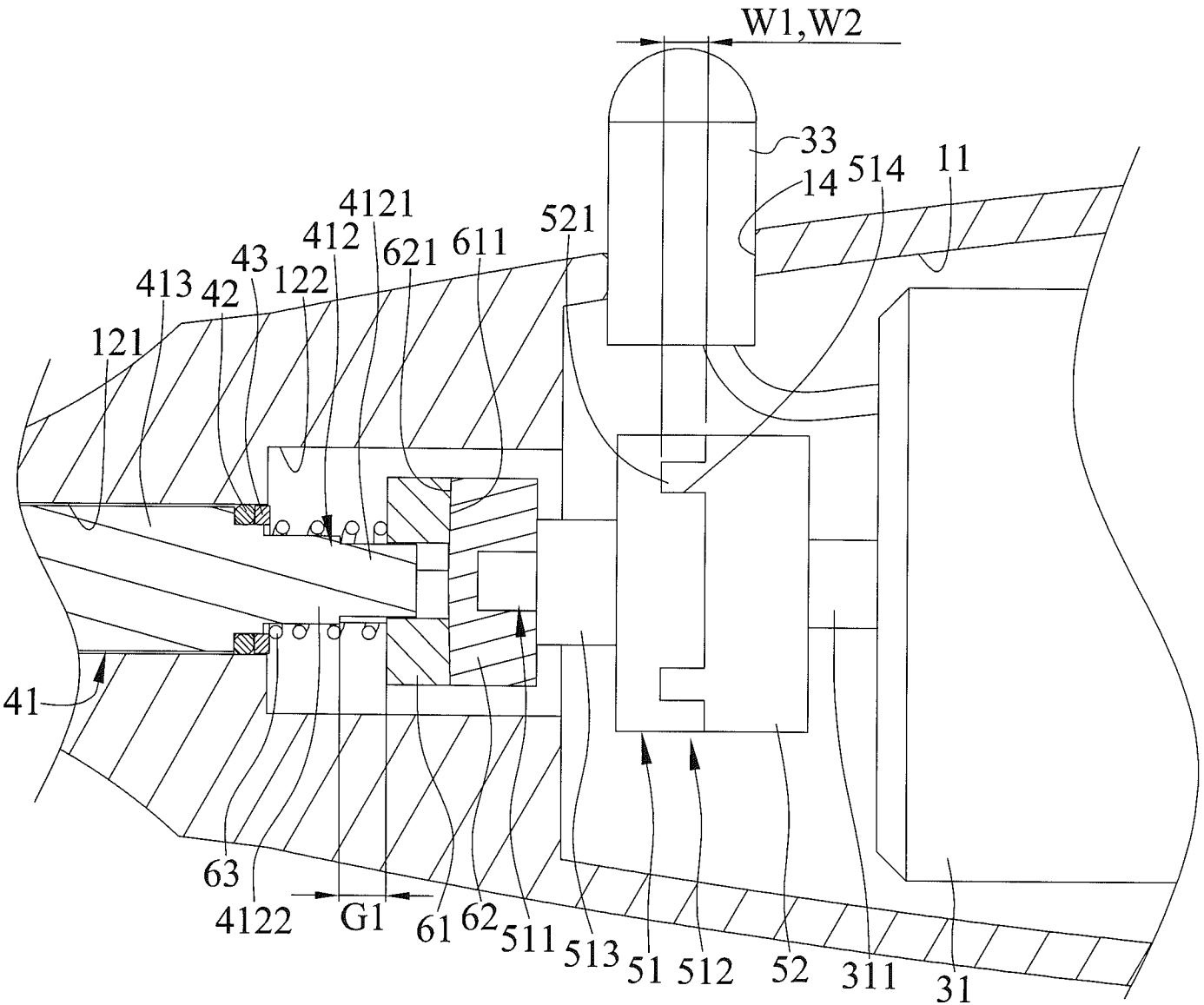
FIG. 4 is an enlarged view of a portion of FIG. 3.
Figure 5:
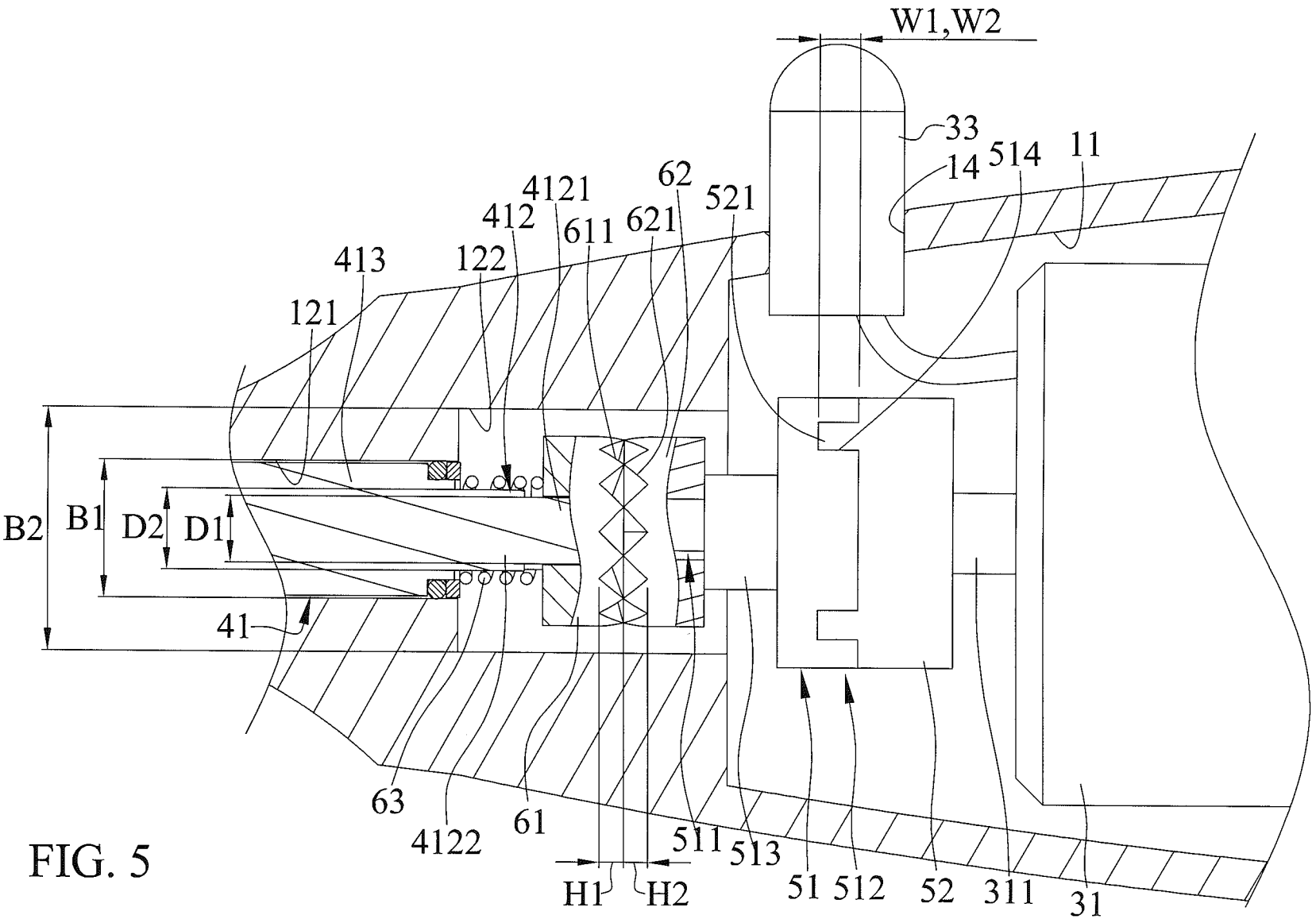
FIG. 5 is a view similar to FIG. 4 with first and second clutch members disengaged from each other and with an elastic element located between the first clutch member and a first transmission device.
Figure 6:
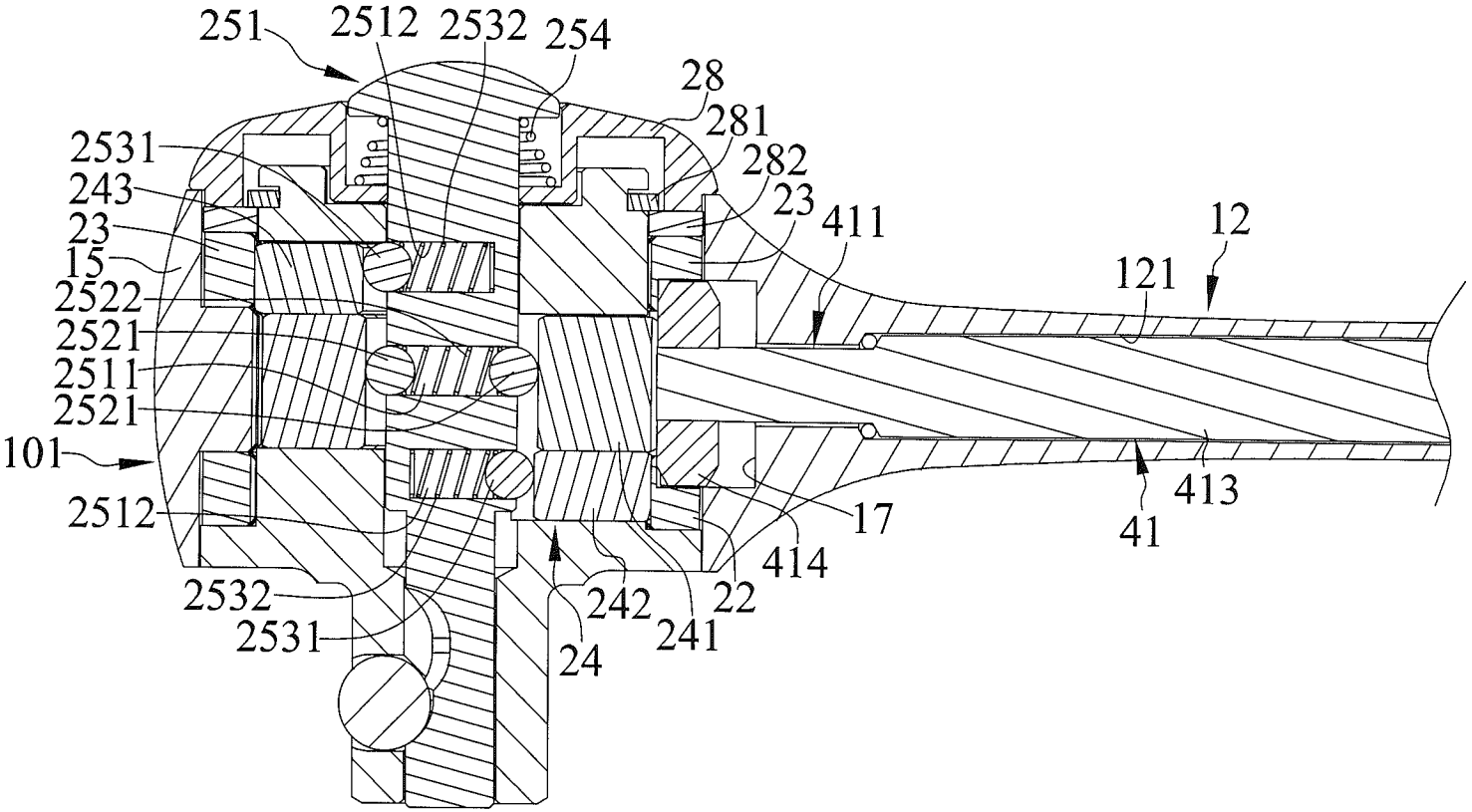
FIG. 6 is an enlarged cross-sectional view of another portion of the electric wrench of FIG. 3, illustrating a connection between the driving device and the first transmission device.

If a resistance smaller than the torque outputted by motor 31 is encountered while driving member 21 is driving a fastener, clutch device 60 is in the coupling state, and first and second clutch portions 611 and 621 engage with each other (FIG. 4). Motor shaft 311 of motor 31 rotates connecting member 52, second transmission device 51, and second clutch member 62 to drive first clutch member 61 and first transmission member 41. Thus, gear 414 drives first and second ring gears 22 and 23 to rotate, and driving member 21 is rotated to continuously and rapidly drive the fastener.

On the other hand, if a large resistance larger than the torque outputted by motor 31 is encountered at a position while driving member 21 is driving the fastener (such as a nut that is stuck on a rusted portion of a long bolt on a construction site and is, thus, cannot pass through the large-resistance position due to the rusted long bolt), first and second clutch portions 611 and 621 repeatedly engage with and disengage from each other, causing the semi-coupling phenomenon. Namely, the clutch device 60 is in the disengagement position, and first clutch member 61 continuously slides in the axial direction of first transmission member 41 relative to first section 4121 of second connection end 412 and compresses elastic element 63 (FIG. 5), such that second transmission device 50 cannot smoothly drive first transmission device 40 to rotate. The user can hear clicks resulting from the semi-coupling phenomenon. In this case, the user can hold body 10 and manually rotate handle 16 about the fastener with a force larger than the torque outputted by motor 31, using toothed portion 131 of body 10 to drive one of primary pawls 241. Thus, driving member 21 is driven by body 10 to drive the fastener through the large-resistance position. After the fastener passes through the large-resistance position, first clutch member 61 reengages with second clutch member 62 under the action of elastic element 63. Thus, driving member 21 can be driven by motor 31 again to continuously and rapidly drive the fastener.

Figure 7:
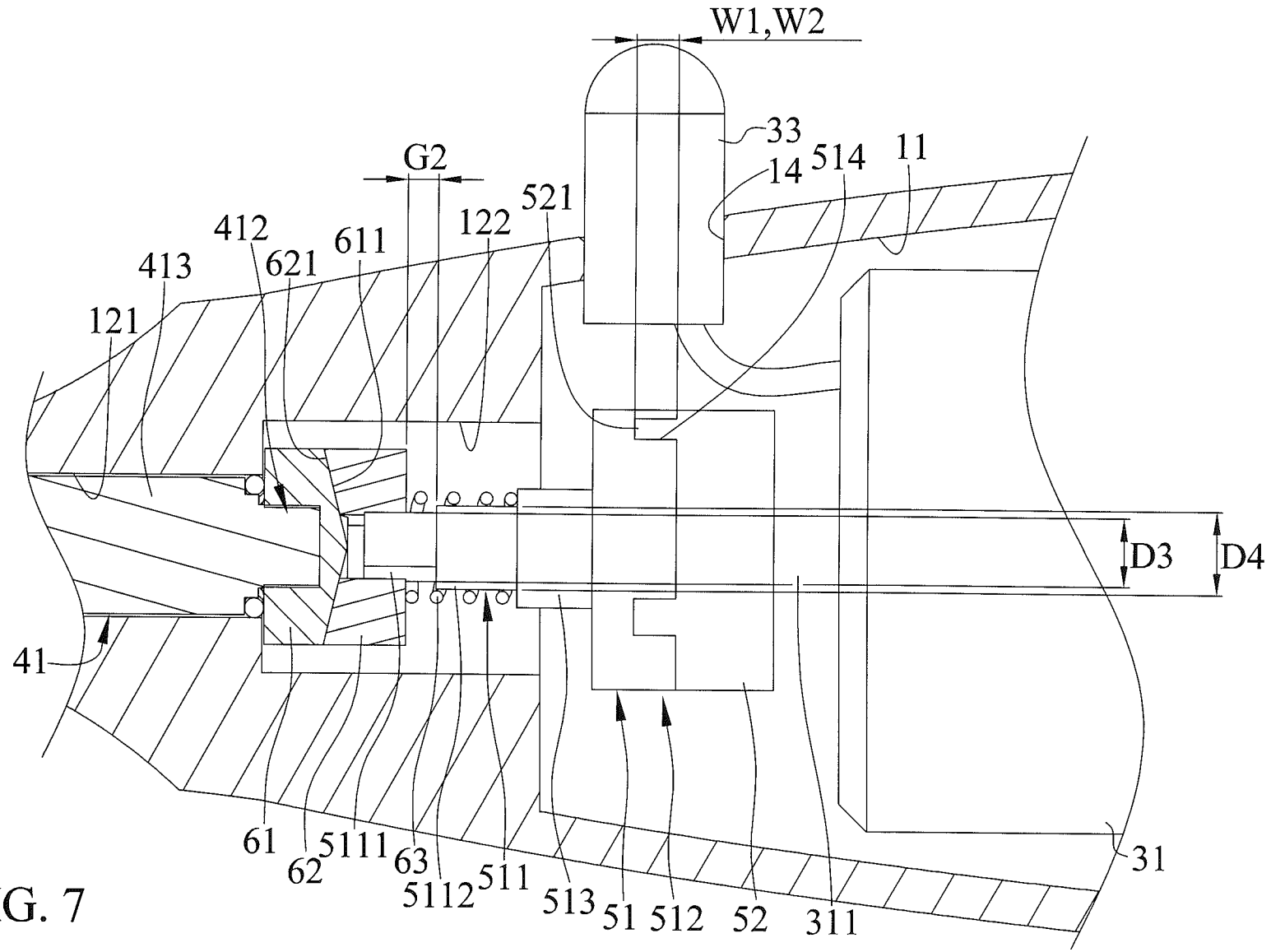
FIG. 7 is a cross-sectional view of a portion of an electric ratchet wrench of a second embodiment according to the present invention including an elastic element mounted between a second clutch member and a second transmission device.

FIG. 7 shows an electric ratchet wrench of a second embodiment according to the present invention. The second embodiment is substantially the same as the first embodiment except that first clutch member 61 is fixed on second connection end 412 of first transmission member 41. Furthermore, second clutch member 62 is slideably mounted on first coupling end 511 of second transmission member 51. Furthermore, elastic element 63 is mounted around first coupling end 511 and mounted between and abutting coupling section 513 and second clutch member 62.

Furthermore, in this embodiment, first coupling end 511 of second transmission member 51 includes a third section 5111 and a fourth section 5112 located between third section 5111 and coupling section 513. Second clutch member 62 is slideably mounted on third section 5111. Third section 5111 has a third diameter D3. Fourth section 5112 has a fourth diameter D4 larger than third diameter D3. Second clutch member 62 can abut against fourth section 5112. Thus, when clutch device 60 is in the disengagement state, first and second clutch members 61 and 62 repeatedly engage with and disengage from each other, causing the semi-coupling phenomenon, such that second clutch member 62 continuously move in the axial direction of second transmission member 51 relative to third section 5111 of first coupling end 511. Fourth section 5112 provides a stopper function for second clutch member 62.

In this embodiment, when second clutch device 60 is in the coupling state, a second spacing G2 exists between second clutch member 62 and fourth section 5112 of first coupling end 511 of second transmission member 51. First coupling tooth height W1 of first shaft coupling section 514 is larger than second spacing G2. Thus, when second clutch device 60 is in the coupling state, the connection between connecting member 52, second transmission member 51, and second clutch member 62 is maintained to avoid disconnection.

FIGS. 8-11 show an electric ratchet wrench of a third embodiment according to the present invention. The third embodiment is substantially the same as the first embodiment. Body 10*a* includes a compartment 11*a* and a connection hole 12*a* having an end in communication with compartment 11*a*. The other end of connection hole 12*a* is in communication with transmission groove 17. First transmission member 41*a* of first transmission device 40*a* is rotatably mounted in connection hole 12*a* and includes a first connection end 411*a*, a second connection end 412*a* connected to first clutch member 61, and a body portion 413*a* between first and second connection ends 411*a* and 412*a*. Second transmission member 51*a* is rotatably mounted in compartment 11*a* and includes a first coupling end 511*a*, a second coupling end 512*a*, and a coupling section 513*a* between first and second coupling ends 511*a* and 512*a*. First coupling end 511*a* is located in connection hole 12*a*. Second coupling end 512*a* is located in compartment 11*a* and is connected to connecting member 52*a*.

In this embodiment, clutch device 60 is mounted in connection hole 12*a* of body 10*a* and does not directly contact with motor 31, and connection hole 12*a* has an inner diameter B. First clutch member 61 is slideably mounted on second connection end 412*a* of first transmission member 41*a*. Second clutch member 62 is securely mounted around first coupling end 511*a* of second transmission member 51*a*. Elastic element 63 is mounted on second coupling end 412*a* and is located between and abuts body portion 413*a* and first clutch member 61.

By mounting clutch device 60 in connection hole 12*a* of body 10*a*, the length ratio of first transmission member 41*a* to second transmission member 51*a* can be adjusted according to the user need. Thus, when a large resistance larger than the torque of motor 13 is encountered at a position, the bending force can be distributed to first and second transmission members 41*a* and 51*a* to avoid deformation of first and second transmission members 41*a* and 51*a* and clutch device 60.

If a large resistance larger than the torque outputted by motor 31 is encountered at a position while driving member 21 is driving the fastener, first and second clutch portions 611 and 621 repeatedly engage with and disengage from each other, causing the semi-coupling phenomenon. Namely, the clutch device 60 is in the disengagement position, and first clutch member 61 continuously slides in the axial direction of first transmission member 41*a* relative to second connection end 412*a* and compresses elastic element 63 (FIG. 11), such that second transmission member 51*a* cannot smoothly drive first transmission member 41*a* to rotate. The user can hear clicks resulting from the semi-coupling phenomenon. In this case, the user can manually rotate handle 16 about the fastener with a force larger than the torque outputted by motor 31. Thus, driving member 21 is driven by body 10*a* to drive the fastener through the large-resistance position. After the fastener passes through the large-resistance position, first clutch member 61 reengages with second clutch member 62 under the action of elastic element 63. Thus, driving member 21 can be driven by motor 31 again to continuously and rapidly drive the fastener.

Figure 12:
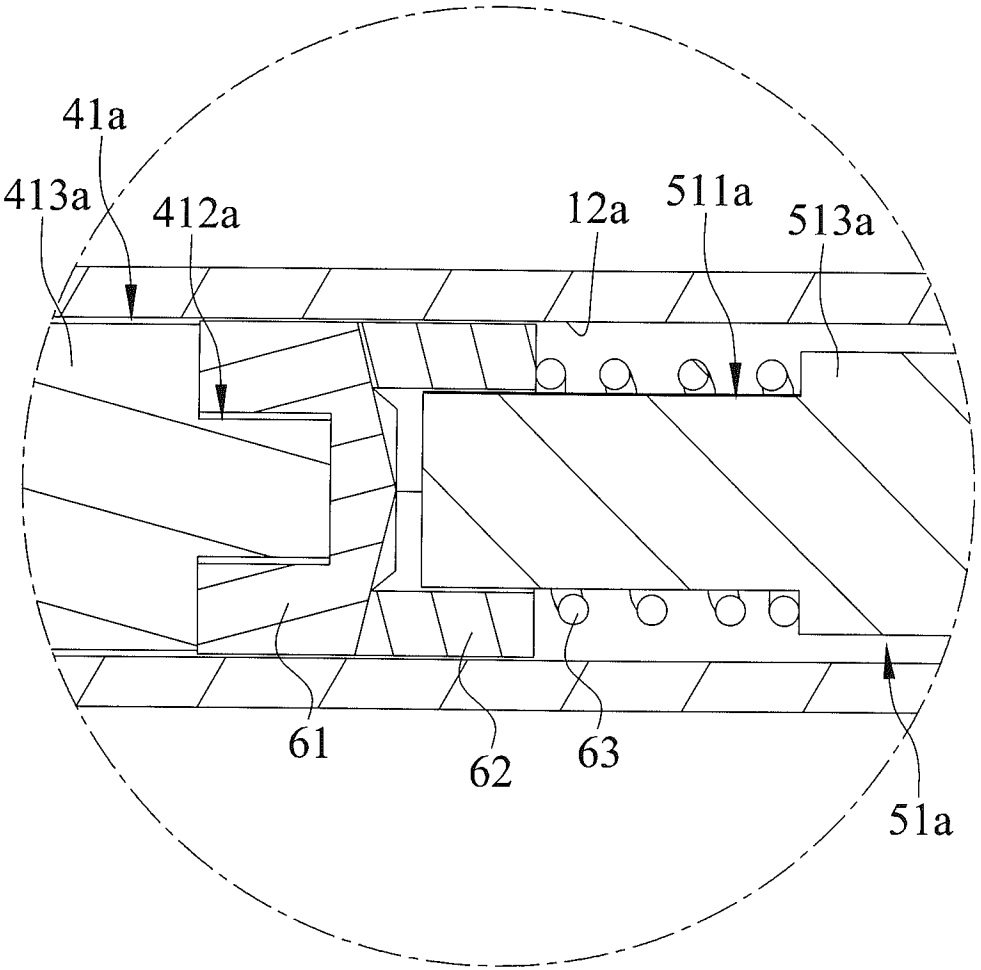
FIG. 12 is an enlarged cross-sectional view of a portion of an electric ratchet wrench of a fourth embodiment according to the present invention including an elastic element mounted between the second clutch member and the second transmission device.
Figure 13:
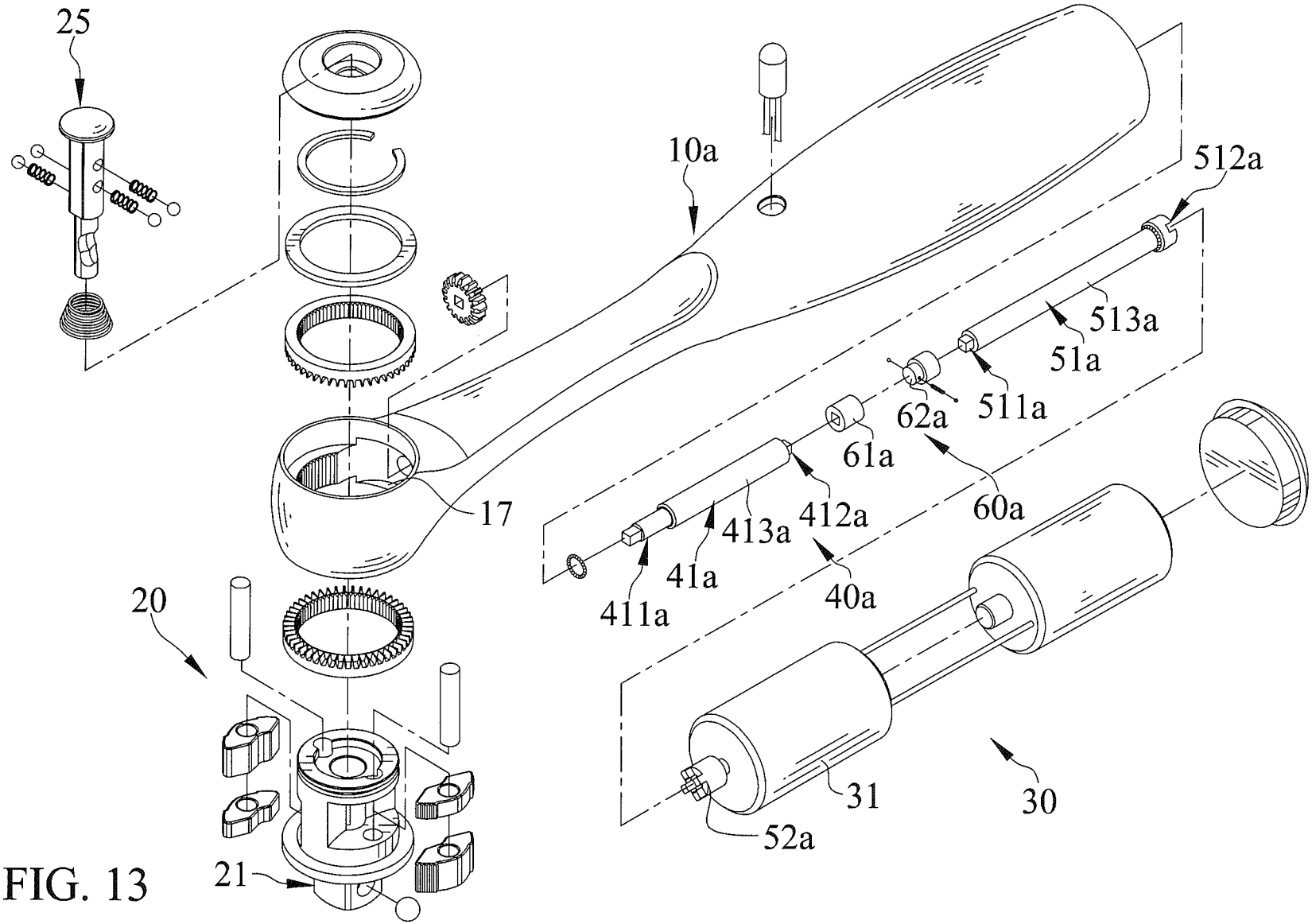
FIG. 13 is an exploded, perspective view of an electric ratchet wrench of a fifth embodiment according to the present invention.
Figure 14:
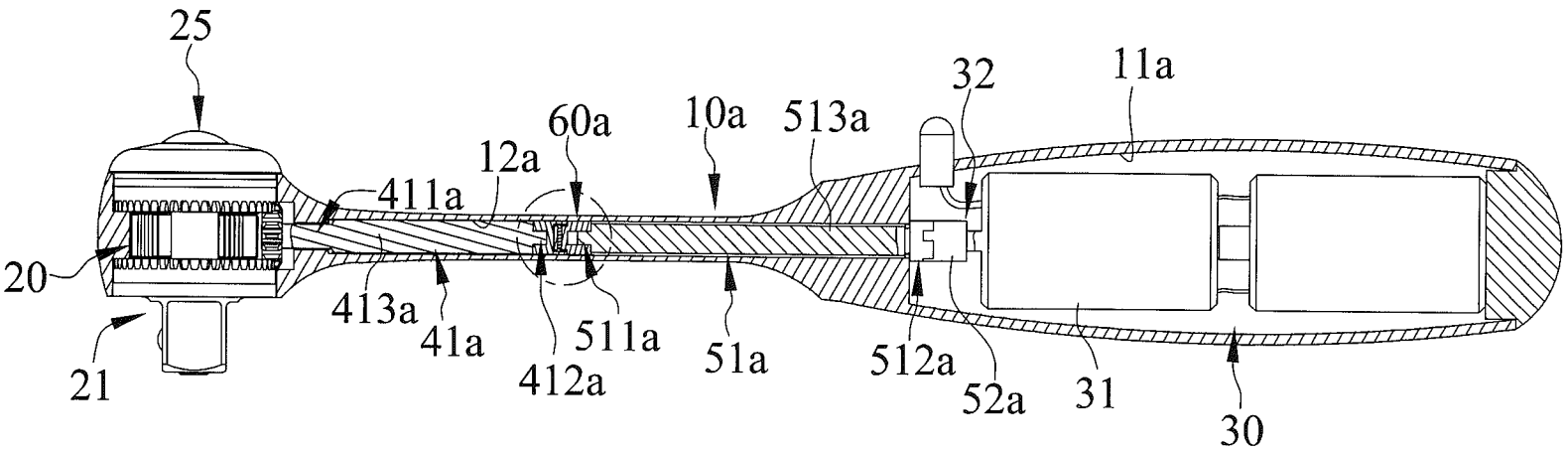
FIG. 14 is a cross-sectional view of the electric ratchet wrench of FIG. 13.
Figure 15:
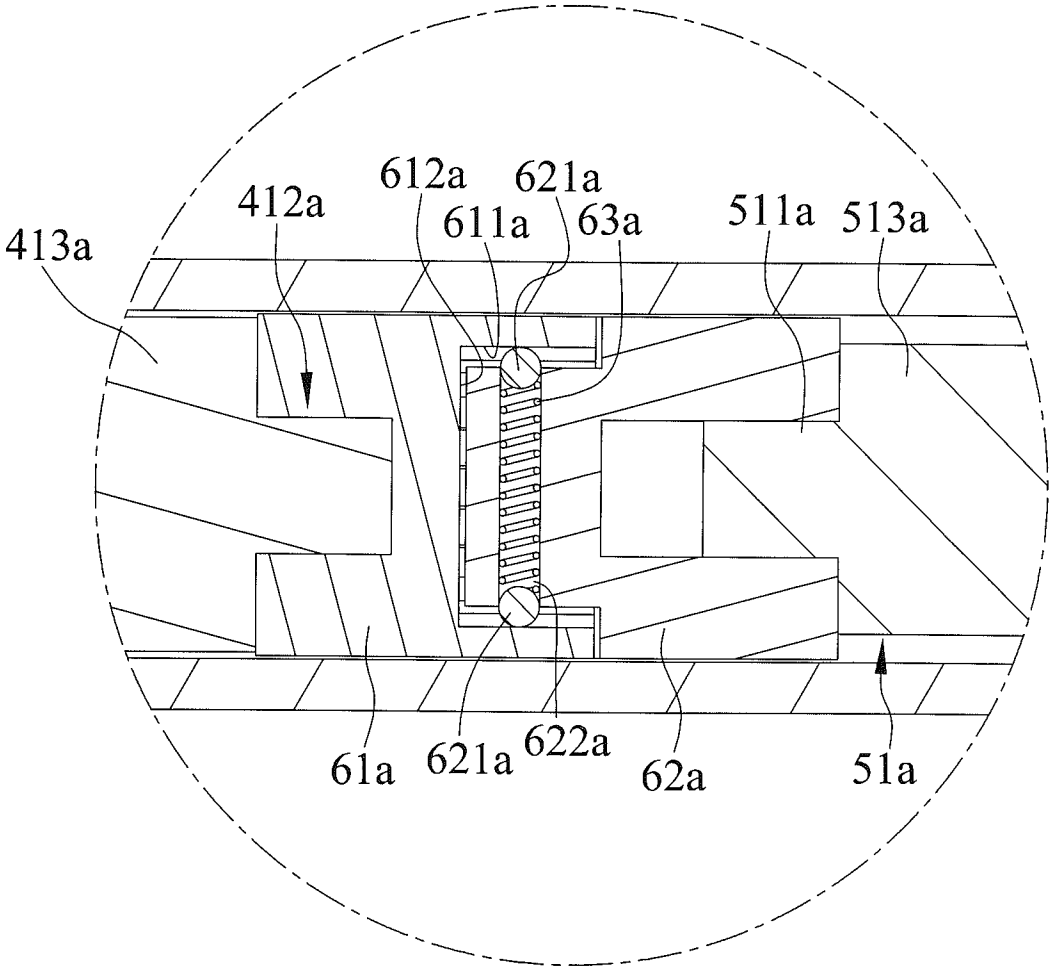
FIG. 15 is an enlarged view of a circled portion of the electric ratchet wrench of FIG. 14.
Figure 16:
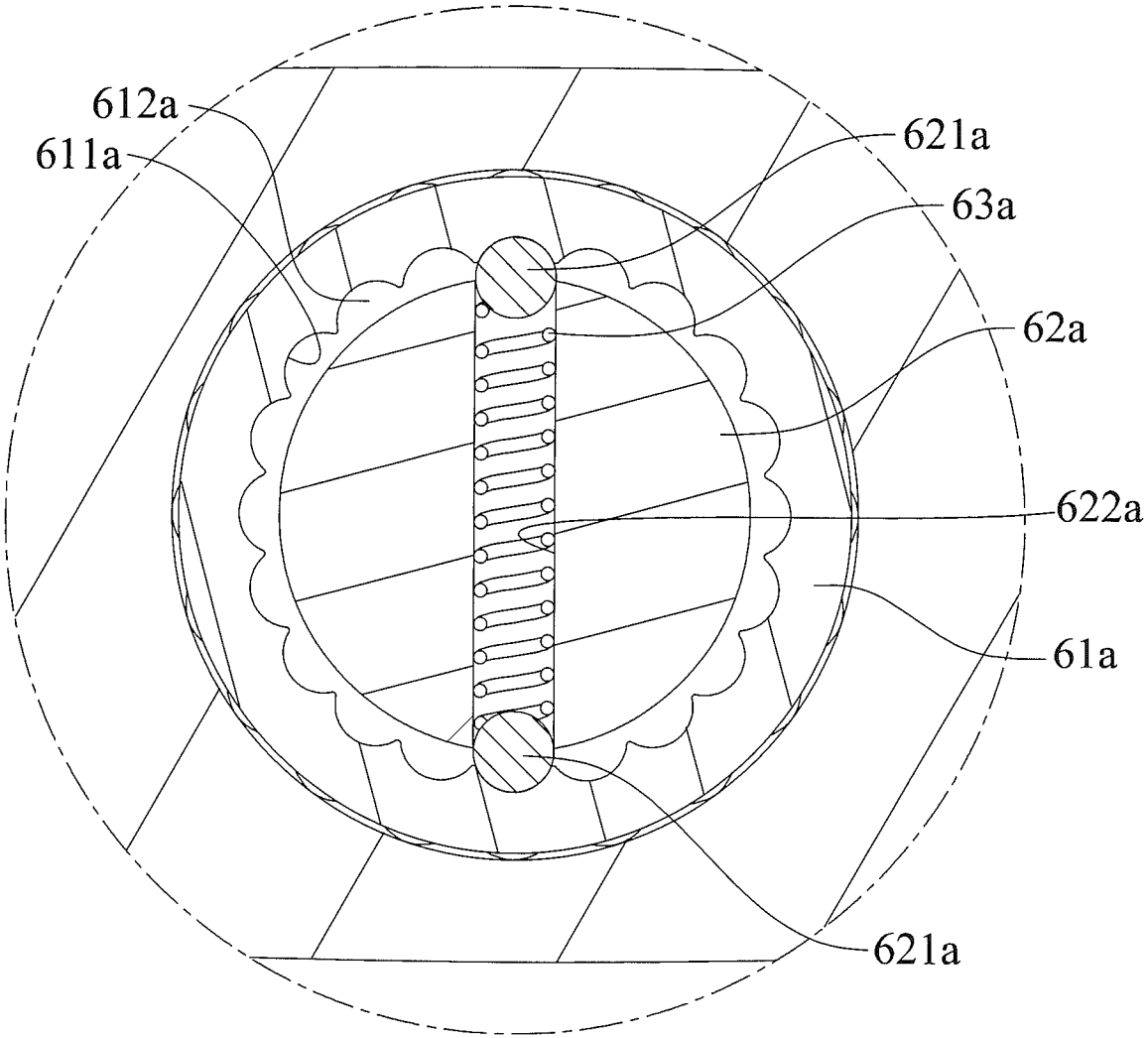
FIG. 16 is another cross-sectional view of the electric ratchet wrench of FIG. 13, illustrating a connection between the first and second clutch members while the clutch device is in a coupling state.
Figure 17:
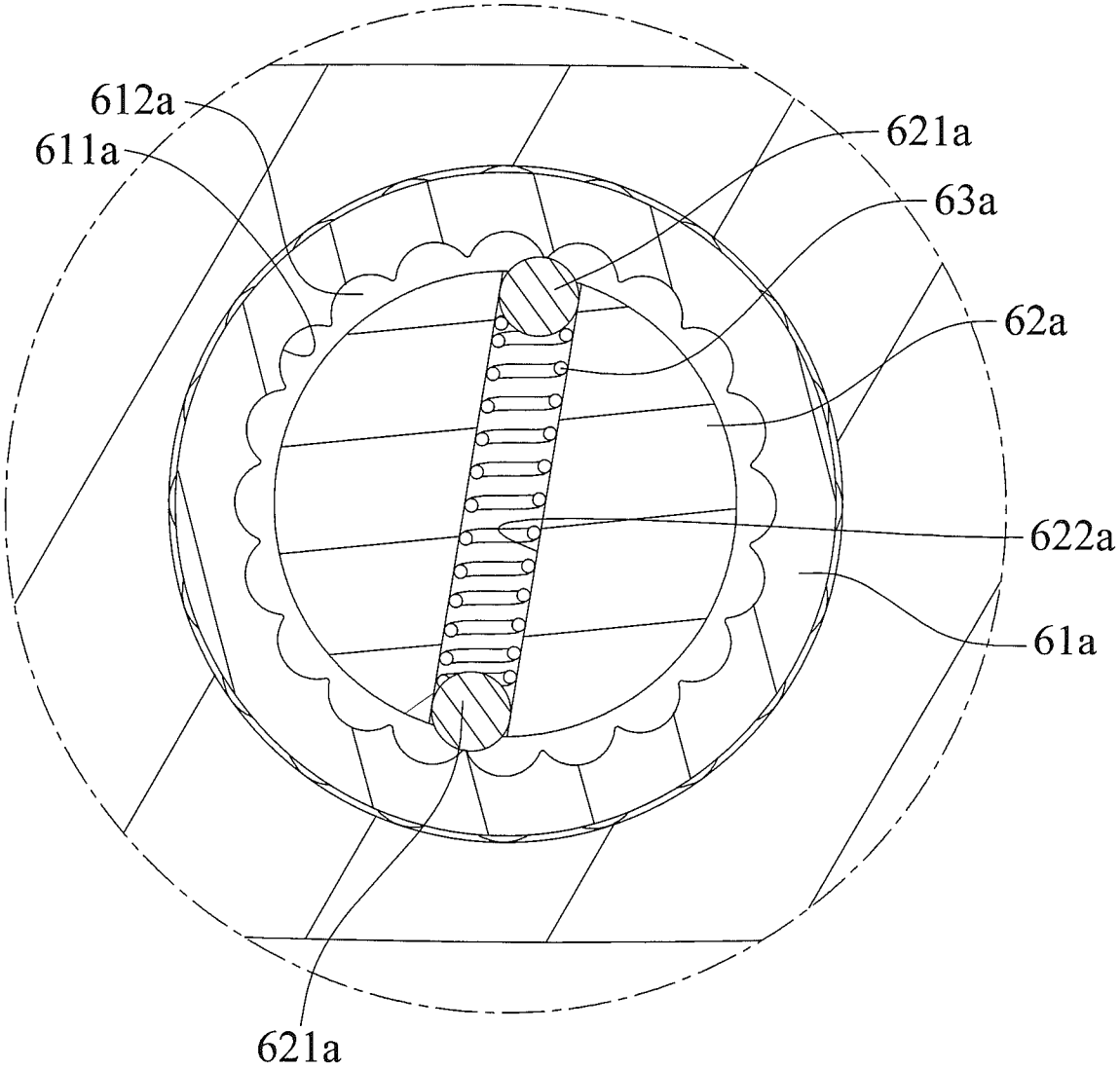
FIG. 17 is a view similar to FIG. 16 with the first and second clutch members in a semi-clutch state while the clutch device is in a disengagement state.
Figure 18:
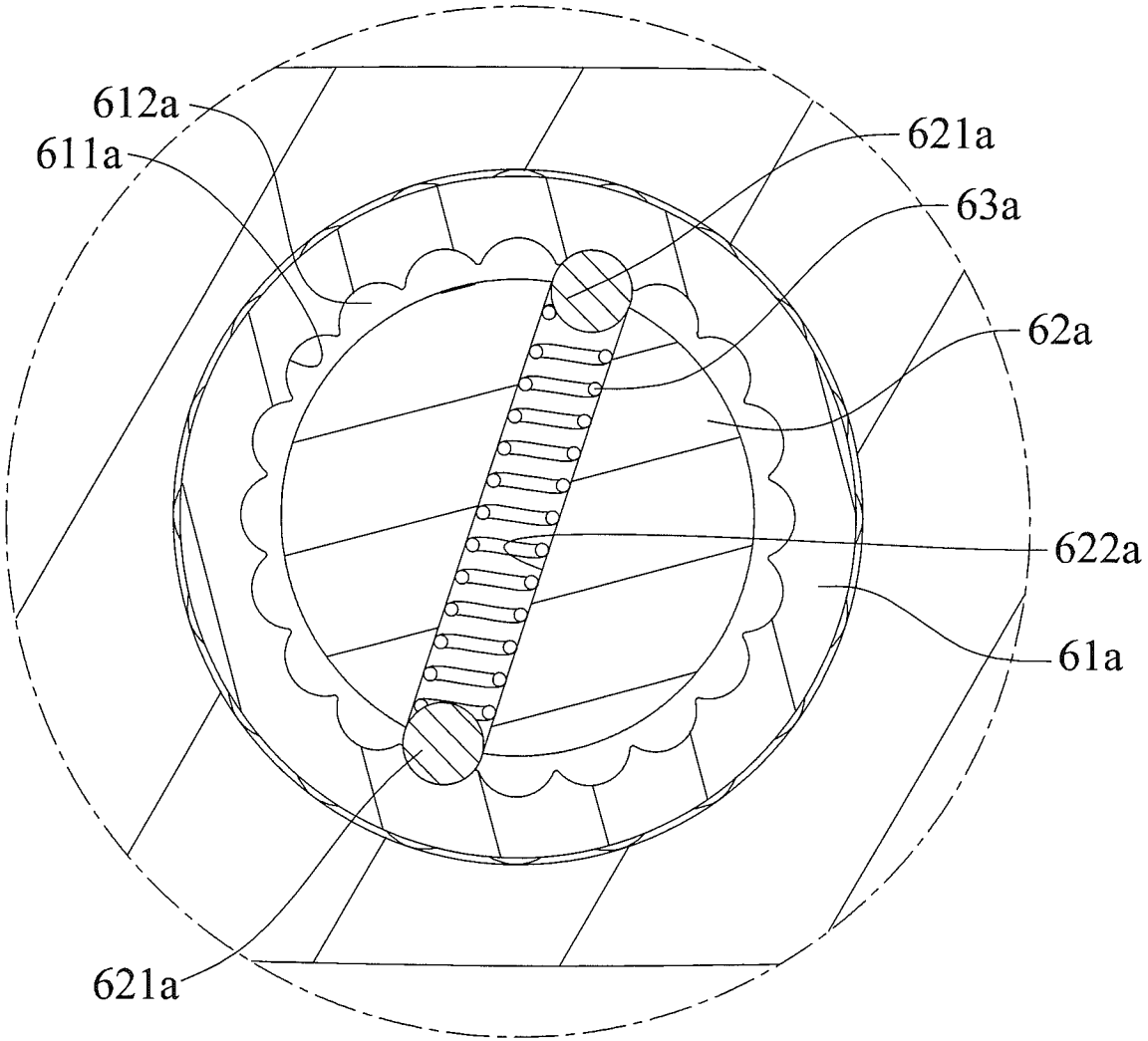
FIG. 18 is a view similar to FIG. 17 with the first and second clutch members reengaged with each other.

FIG. 12 shows an electric ratchet wrench of a fourth embodiment according to the present invention. The fourth embodiment is substantially the same as the third embodiment except that first clutch member 61 is securely mounted on second connection end 412*a* of first transmission member 41*a*. Furthermore, second clutch member 62 is slideably mounted on first coupling end 511*a* of second transmission member 51*a*. Furthermore, elastic element 63 is mounted on first coupling end 511*a* of first transmission member 51*a* and is mounted between and abuts coupling section 513*a* and second clutch member 62.

Figure 8:
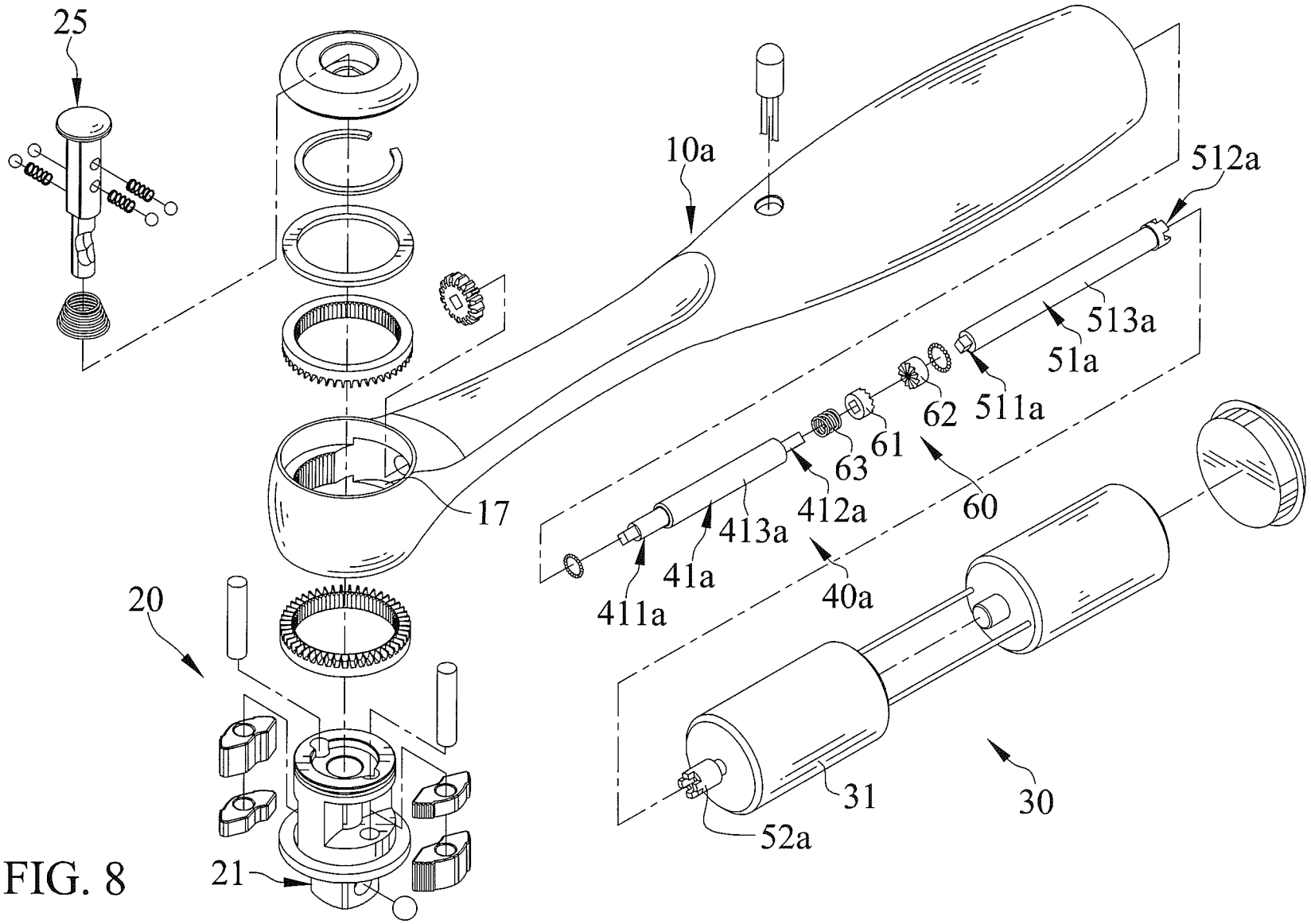
FIG. 8 is an exploded, perspective view of an electric ratchet wrench of a third embodiment according to the present invention.
Figure 9:
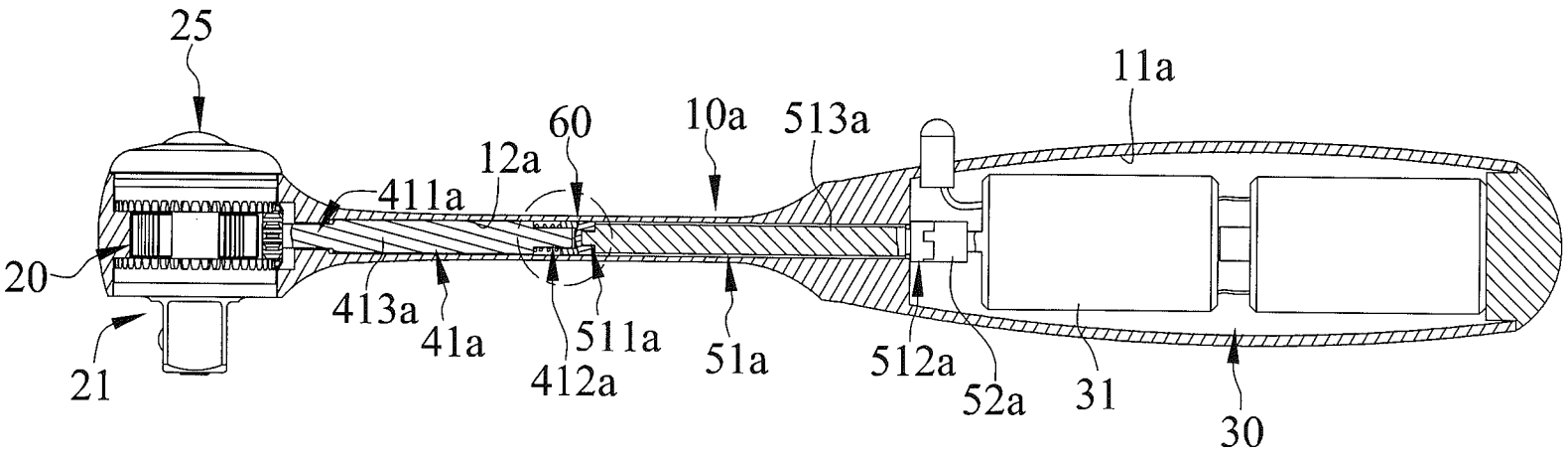
FIG. 9 is a cross-sectional view of the electric ratchet wrench of FIG. 8.
Figure 10:
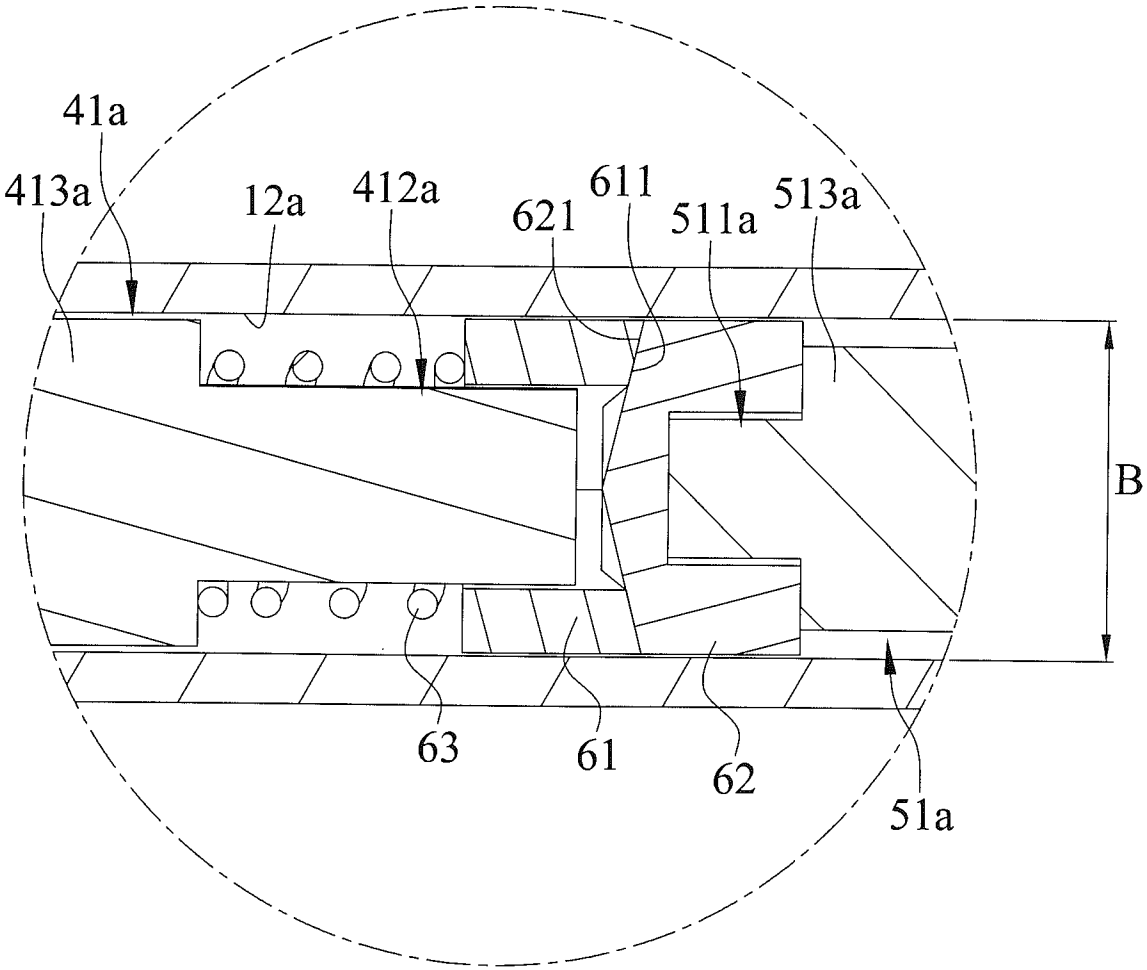
FIG. 10 is an enlarged view of a circled portion of the electric ratchet wrench of FIG. 9, illustrating a connection between the first and second clutch members.
Figure 11:
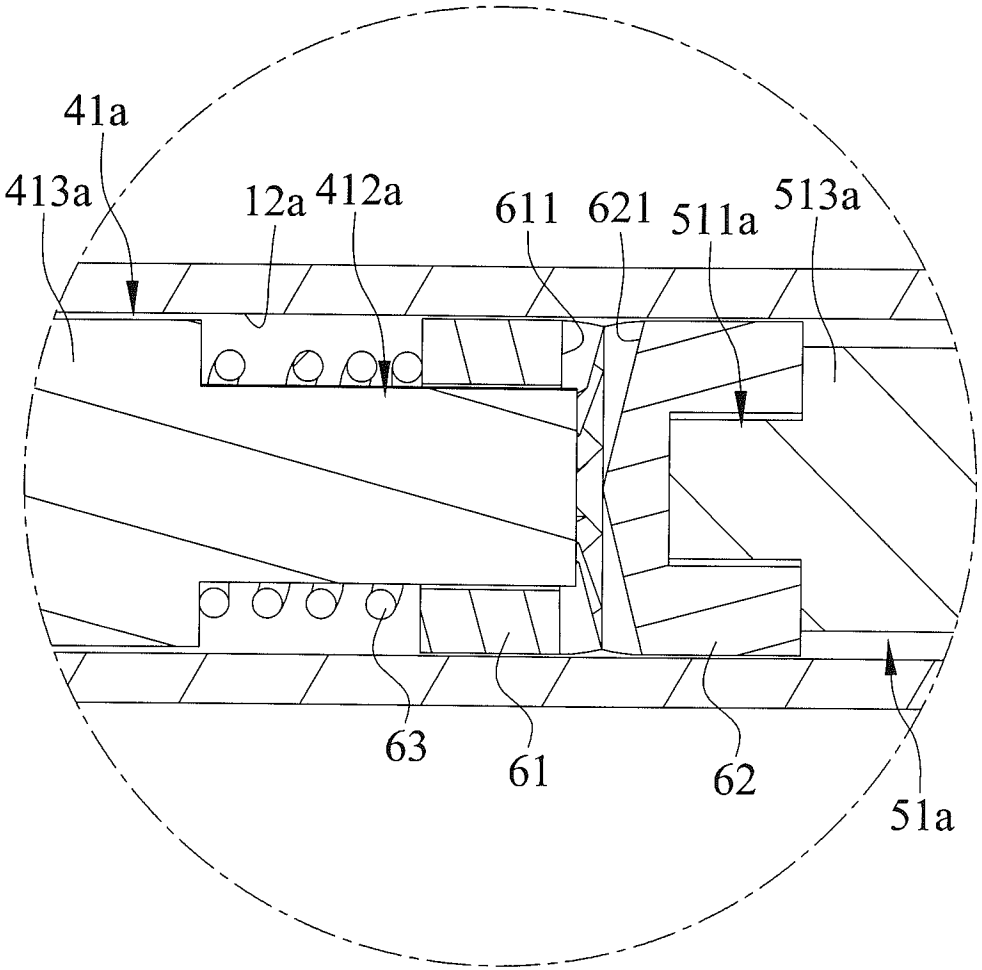
FIG. 11 is a view similar to FIG. 10 with the first and second clutch members disengaged from each other and with the elastic element located between the first clutch member and the first transmission device.

When clutch device 60 is in the disengagement state, second clutch member 62 continuously slides relative to first coupling end 511*a* of second transmission member 51*a* and compresses elastic element 63, such that first transmission member 41*a* is less likely to vibrate due to sliding movement of second clutch member 62, reliably maintaining the connection between first transmission member 41*a* and driving device 20 (c.f. FIG. 8).

FIGS. 13-18 show an electric ratchet wrench of a fifth embodiment according to the present invention. The fifth embodiment is substantially the same as the third embodiment except that first clutch member 61*a* further includes a connection portion 612*a* on an end face of first clutch member 61*a* opposite to first transmission member 41*a*. Second clutch member 62*a* is rotatably connected to connection portion 612*a* of first clutch member 61*a* and includes a through-hole 622*a*. Elastic element 63*a* is received in through-hole 622*a* and abuts against the at least one second clutch portion 621*a*. The at least one second clutch portion 621*a* selectively engages with the at least one first clutch portion 611*a* of first clutch member 61*a*.

In this embodiment, connection portion 612*a* is a hole. First clutch member 61*a* includes a plurality of first clutch portions 611*a* provided on an inner periphery of connection portion 612*a* and spaced from each other in a circumferential portion of connection portion 612*a*. Each first clutch portion 611*a* is in the form of an arcuate groove.

In this embodiment, through-hole 622*a* extends through two opposite sides of second clutch member 62*a*. Second clutch member 62*a* includes two second clutch portions 621*a* slideably received in through-hole 622*a*. Each second clutch portion 621*a* is in the form of a ball.

When a resistance smaller than a torque outputted by power device 30 is encountered while driving device 20 is driving a fastener, clutch device 60 is in the coupling state, the two second clutch portions 621*a* of second clutch member 62*a* engage with two of the first clutch portions

611*a* of first clutch member 61*a*, such that first and second clutch members 61*a* and 62*a* couple with each other and can rotate about the same axis. Second clutch member 62*a* cannot rotate relative to connection portion 612*a* of first clutch member 61*a*. Motor 31 can rotate connecting member 52*a*, second transmission member 51*a*, and second clutch member 62*a*, which, in turn, drives first clutch member 61*a* and first transmission member 41*a*, thereby rotating the driving member 21 to continuously and rapidly drive the fastener.

If a large resistance larger than the torque outputted by motor 31 is encountered at a position while driving member 21 is driving the fastener, first clutch portions 611*a* of first clutch member 61*a* repeatedly engage with and disengage from the two second clutch portions 621*a* of second clutch member 62*a*, causing the semi-coupling phenomenon. Namely, clutch device 60*a* is in the disengagement position, second clutch member 62*a* continuously rotate relative to connecting portion 612*a* of first clutch member 61*a*, and the two second clutch portions 621*a* continuously slide in through-hole 622*a* in the diametric direction of second clutch member 62*a* and compresses elastic element 63*a*, such that second clutch member 62*a* cannot drive first clutch member 61*a*. In this case, the user can manually rotate body 10*a* with a force larger than the torque outputted by motor 31. Thus, driving member 21 is driven by body 10*a* to drive the fastener through the large-resistance position. After the fastener passes through the large-resistance position, the two second clutch portions 621*a* of second clutch member 62*a* reengages with another two of the first clutch portions 611*a* of first clutch member 61*a* under the action of elastic element 63*a*, changing clutch device 60*a* from the disengagement state to the coupling state. Thus, first and second clutch members 61*a* and 62*a* couple with each other and can rotate about the same axis. Second clutch member 62*a* cannot rotate relative to connection portion 612*a* of first clutch member 61*a*.

In view of the foregoing, when a resistance smaller than a torque outputted by power device 30 is encountered while driving member 21 is driving a fastener, clutch device 60, 60*a* is in the coupling state, power device 30 drives second transmission device 50 and clutch device 60, 60*a* to drive first transmission device 40, 40*a* to rotate, and gear 414 drives first and second ring gears 22 and 23. Thus, driving member 21 is rotated to continuously and rapidly drive the fastener, achieving a force-saving effect and a time-saving effect.

When a large resistance larger than the torque outputted by power device 30 is encountered at a position while driving device 20 is driving the fastener, clutch device 60 is in the disengagement state, the torque of power device 30 is not permitted to be transmitted through second transmission device 50 to first transmission device 40, 40*a*, yet body 10, 10*a* is permitted to be manually rotated to overcome the large resistance and to forcibly drive the fastener through the position via driving device 20, and clutch device 60, 60*a* returns to the coupling state after the fastener passes through the position.

Furthermore, in the embodiment in which second inner diameter B2 is larger than first inner diameter B1, clutch device 60 can include first and second clutch members 61 and 62 of larger diameters to increase the structural strength while increasing the contact area between first and second clutch members 61 and 62, effectively withstanding the bending force resulting from the large resistance larger than the torque outputted by motor 31 of power device 30.

Furthermore, in the embodiment in which clutch device 60 is mounted in connection hole 12*a* of body 10*a*, the length ratio of first transmission member 41*a* to second transmission member 51*a* can be adjusted according to the user need. Thus, when a large resistance larger than the torque of motor 13 is encountered at a position, the bending force can be distributed to first and second transmission members 41*a* and 51*a* to avoid deformation of first and second transmission members 41*a* and 51*a* and clutch device 60.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An electric ratchet wrench comprising:

a body including first and second ends along a first axis;

a driving device mounted to the first end of the body, with the driving device adapted to drive a fastener about a second axis perpendicular to the first axis;

a power device mounted to the second end of the body, with the power device adapted to provide electricity for operation;

a first transmission device mounted between the driving device and the power device, with the first transmission device rotatably received in the body and connected to the driving device, and with the first transmission device including an extension having a first shape;

a second transmission device mounted between the driving device and the power device, with the second transmission device rotatably mounted in the body and connected to the power device; and a clutch device mounted between the first transmission device and the second transmission device, with the clutch device switchable between a coupling state when a resistance smaller than a torque output by the power device is encountered while the driving device is driving the fastener to rotate about the second axis and a disengagement state when a resistance larger than the torque output by the power device is encountered at a position while the driving device is driving the fastener to rotate about the second axis, wherein the clutch device includes a first clutch member mounted to the first transmission device, a second clutch member mounted to the second transmission device, and an elastic element abutting the first clutch member, with the first clutch member and the second clutch member disengageably engaged with each other; wherein the first clutch member comprises a center through-opening having a complementary shape to the first shape of the extension of the first transmission device, wherein the through-opening is configured to slidingly-receive the extension of the first transmission device; wherein the clutch device is configured to switch between the coupling state and the disengagement state at least by the first clutch member sliding along an outer portion of the extension of the first transmission device via the through-opening, generally along the first axis;

with the clutch device in the coupling state, the power device drives the second transmission device and the clutch device to drive the first transmission device to rotate about the first axis, and the driving device is rotated to continuously drive the fastener to rotate about the second axis without moving the body, with the clutch device in the disengagement state, the torque of the power device is not permitted to be transmitted through the second transmission device to the first transmission device, the body is manually rotated to overcome the resistance and to forcibly drive the fastener through the position via the driving device, wherein the clutch device returns to the coupling state after the fastener passes through the position, and wherein the driving device again drives the fastener to rotate about the second axis without moving the body, with the clutch device in the disengagement state, the first clutch member and the second clutch member repeatedly engage with and disengage from each other, the one of the first clutch member and the second clutch member compresses the elastic element, the body is manually rotated to overcome the resistance and to forcibly drive the fastener through the position via the driving device, and the clutch device returns to the coupling state under action of the elastic element after the fastener passes through the position; and wherein the elastic element is between the first transmission device and the first clutch member.

2. The electric ratchet wrench as claimed in claim 1, wherein the first clutch member and the second clutch member engage with each other when the clutch device is in the coupling state, and wherein the first clutch member and the second clutch member are in a semi-coupling state repeatedly engaging with and disengaging from each other when the clutch device is in the disengagement state.

3. The electric ratchet wrench as claimed in claim 2, with the first clutch member including at least one first clutch portion, with the second clutch member including at least one second clutch portion, and with the at least one first clutch portion and the at least one second clutch portion disengageably engaged with each other.

4. The electric ratchet wrench as claimed in claim 3, with the first transmission device including a first transmission member, with the first transmission member including a first connection end, a second connection end, and a body portion between the first connection end and the second connection end, with the first connection end connected to the driving device, and with the first clutch member slideably mounted on the second connection end.

5. The electric ratchet wrench as claimed in claim 3, with the second transmission device including a second transmission member, with the second transmission member including a first coupling end, a second coupling end, and a coupling section between the first coupling end and the second coupling end, the second clutch member slideably mounted on the first coupling end, and with the second coupling end connected to the power device.

6. The electric ratchet wrench as claimed in claim 1, with the body further including a compartment located in the second end of the body and a connection hole in communication with the compartment, with the power device received in the compartment, with the first transmission device and the clutch device rotatably mounted in the connection hole, and with the second transmission device rotatably mounted in the compartment.

7. The electric ratchet wrench as claimed in claim 6, with the connection hole including a first section having a first inner diameter and a second section in communication with the first section and the compartment and having a second inner diameter larger than the first inner diameter, with the first transmission device rotatably mounted in the first section, with the clutch device rotatably mounted in the second section, and with the second transmission device rotatably mounted between the compartment and the second section of the connection hole.

8. The electric ratchet wrench as claimed in claim 1, with the driving device including a driving member rotatably mounted in the first end of the body and a first ring gear rotatably mounted to the driving member for driving the driving member to rotate, with the first ring gear including a side toothed portion on an end face thereof, and with the first transmission member including a gear meshed with the side toothed portion of the first ring gear.

9. The electric ratchet wrench as claimed in claim 8, with the body including a driving hole having an inner periphery with a toothed portion, with the driving device further including a second ring gear, a pawl device, and a direction switching device, with the second gear ring rotatably mounted to the driving member and spaced from the first ring gear, with the first ring gear further including an inner toothed portion on an inner periphery thereof, with the second ring gear including a side toothed portion on an end face thereof and an inner toothed portion on an inner periphery thereof, with the inner toothed portions of the first and second ring gears selectively engaged with the pawl device, with the side toothed portion of the second ring gear meshed with the gear of the first transmission member, with the pawl device including two primary pawls, a first secondary pawl, and a second secondary pawl, with each of the two primary pawls configured to selectively mesh with the toothed portion of the body, with the first secondary pawl configured to selectively mesh with the inner toothed portion of the first ring gear, with the second secondary pawl configured to selectively mesh with the inner toothed portion of the second ring gear, with the direction switching device including a direction switching rod extending through the driving member, with the direction switching rod pivotable relative to the driving member between two positions respectively corresponding to a driving direction and a non-driving direction, wherein when the direction switching rod pivots between the two positions, an engagement status between each of the two primary pawls and the toothed portion of the body and an engagement status between the first and second secondary pawls and the first and second ring gears are changed to provide a direction switching function.

10. The electric ratchet wrench as claimed in claim 5, with the body further including a compartment located in the second end of the body and a connection hole in communication with the compartment, with the Power device received in the compartment, with the first transmission device and the clutch device rotatably mounted in the connection hole, and with the second transmission device rotatably mounted in the compartment.

11. The electric ratchet wrench as claimed in claim 10, with the connection hole including a first section having a first inner diameter and a second section in communication with the first section and the compartment and having a second inner diameter larger than the first inner diameter, with the first transmission device rotatably mounted in the first section, with the clutch device rotatably mounted in the second section, and with the second transmission device rotatably mounted between the compartment and the second section of the connection hole.

12. The electric ratchet wrench as claimed in claim 11, with the driving device including a driving member rotatably mounted in the first end of the body and a first ring gear rotatably mounted to the driving member for driving the driving member to rotate, with the first ring gear further including a side toothed portion on an end face thereof, and with the first transmission member further including a gear meshed with the side toothed portion of the first ring gear.

13. The electric ratchet wrench as claimed in claim 12, with the body including a driving hole having an inner periphery with a toothed portion, with the driving device further including a second ring gear, a pawl device, and a direction switching device, with the second gear ring rotatably mounted to the driving member and spaced from the first ring gear, with the first ring gear further including an inner toothed portion on an inner periphery thereof, with the second ring gear including a side toothed portion on an end face thereof and an inner toothed portion on an inner periphery thereof, with the inner toothed portions of the first and second ring gears selectively engaged with the pawl device, with the side toothed portion of the second ring gear meshed with the gear of the first transmission member, with the pawl device including two primary pawls, a first secondary pawl, and a second secondary pawl, with each of the two primary pawls configured to selectively mesh with the toothed portion of the body, with the first secondary pawl configured to selectively mesh with the inner toothed portion of the first ring gear, with the second secondary pawl configured to selectively mesh with the inner toothed portion of the second ring gear, with the direction switching device including a direction switching rod extending through the driving member, with the direction switching rod pivotable relative to the driving member between two positions respectively corresponding to a driving direction and a non-driving direction, wherein when the direction switching rod pivots between the two positions, an engagement status between each of the two primary pawls and the toothed portion of the body and an engagement status between the first and second secondary pawls and the first and second ring gears are changed to provide a direction switching function.

14. An electric ratchet wrench comprising:

a body including first and second ends along a first axis;

a driving device mounted to the first end of the body, with the driving device adapted to drive a fastener about a second axis perpendicular to the first axis;

a power device mounted to the second end of the body, with the power device adapted to provide electricity for Operation;

a first transmission device mounted between the driving device and the power device, with the first transmission device rotatably received in the body and connected to the driving device, and with the first transmission device including an extension having a first shape;

a second transmission device mounted between the driving device and the power device, with the second transmission device rotatably mounted in the body and connected to the power device; and a clutch device mounted between the first transmission device and the second transmission device, with the clutch device switchable between a coupling state and a disengagement state due to a resistance, wherein the clutch device includes a first clutch member mounted to the first transmission device, a second clutch member mounted to the second transmission device, and an elastic element abutting one of the first clutch member and the second clutch member, with the first clutch member and the second clutch member disengageably engaged with each other; wherein the first clutch member comprises a center through-opening having a complementary shape to the first shape of the extension of the first transmission device, wherein the through-opening is configured to slidingly-receive the extension of the first transmission device; wherein the clutch device is configured to switch between the coupling state and the disengagement state at least by the first clutch member sliding along an outer portion of the extension of the first transmission device via the through-opening, generally along the first axis;

with the clutch device in the coupling state, the power device drives the second transmission device and the clutch device to drive the first transmission device to rotate about the first axis, and the driving device is rotated to continuously drive the fastener to rotate about the second axis without moving the body, with the clutch device in the disengagement state, torque of the power device is not permitted to be transmitted through the second transmission device to the first transmission device, the body is manually rotated to overcome the resistance and to forcibly drive the fastener through a position via the driving device, wherein the clutch device returns to the coupling state after the fastener passes through the position, and wherein the driving device again drives the fastener to rotate about the second axis without moving the body, and with the clutch device in the disengagement state, the first clutch member and the second clutch member repeatedly engage with and disengage from each other, the one of the first clutch member and the second clutch member compresses the elastic element, the body is manually rotated to overcome the resistance and to forcibly drive the fastener through the position via the driving device, and the clutch device returns to the coupling state under action of the elastic element after the fastener passes through the position.

15. An electric ratchet wrench comprising:

a body including first and second ends along a first axis;

a driving device mounted to the first end of the body, with the driving device adapted to drive a fastener about a second axis perpendicular to the first axis;

a power device mounted to the second end of the body, with the power device adapted to provide electricity for operation;

a first transmission device mounted between the driving device and the power device, with the first transmission device rotatably received in the body and connected to the driving device, and with the first transmission device including an extension having a first shape;

a second transmission device mounted between the driving device and the power device, with the second transmission device rotatably mounted in the body and connected to the power device; and a clutch device mounted between the first transmission device and the second transmission device, with the clutch device switchable between a coupling state when a resistance smaller than a torque output by the power device is encountered while the driving device is driving the fastener to rotate about the second axis and a disengagement state when a resistance larger than the torque output by the power device is encountered at a position while the driving device is driving the fastener to rotate about the second axis, wherein the clutch device includes a first clutch member mounted to the first transmission device, a second clutch member mounted to the second transmission device, and an elastic element, with the first clutch member and the second clutch member disengageably engaged with each other; wherein the first clutch member comprises a center through-opening having a complementary shape to the first shape of the extension of the first transmission device, wherein the through-opening is configured to slidingly-receive the extension of the first transmission device; wherein the clutch device is configured to switch between the coupling state and the disengagement state at least by the first clutch member sliding along an outer portion of the extension of the first transmission device via the through-opening, generally along the first axis;

with the clutch device in the coupling state, the power device drives the second transmission device and the clutch device to drive the first transmission device to rotate about the first axis, and the driving device is rotated to continuously drive the fastener to rotate about the second axis without moving the body, with the clutch device in the disengagement state, the torque of the power device is not permitted to be transmitted through the second transmission device to the first transmission device, the body is manually rotated to overcome the resistance and to forcibly drive the fastener through the position via the driving device, wherein the clutch device returns to the coupling state after the fastener passes through the position, and wherein the driving device again drives the fastener to rotate about the second axis without moving the body, and with the clutch device in the disengagement state, the first clutch member and the second clutch member repeatedly engage with and disengage from each other, the one of the first clutch member and the second clutch member compresses the elastic element, the body is manually rotated to overcome the resistance and to forcibly drive the fastener through the position via the driving device, and the clutch device returns to the coupling state under action of the elastic element after the fastener passes through the position;

wherein the first clutch member and the second clutch member engage with each other when the clutch device is in the coupling state, and wherein the first clutch member and the second clutch member are in a semi-coupling state repeatedly engaging with and disengaging from each other when the clutch device is in the disengagement state; and with the first clutch member including at least one first clutch portion, with the second clutch member including at least one second clutch portion, and with the at least one first clutch portion and the at least one second clutch portion disengageably engaged with each other.

16. An electric ratchet wrench comprising:

a body including first and second ends along a first axis;

a driving device mounted to the first end of the body, with the driving device adapted to drive a fastener about a second axis perpendicular to the first axis;

a power device mounted to the second end of the body, with the power device adapted to provide electricity for operation;

a first transmission device mounted between the driving device and the power device, with the first transmission device rotatably received in the body and connected to the driving device, and with the first transmission device including an extension having a first shape;

a second transmission device mounted between the driving device and the power device, with the second transmission device rotatably mounted in the body and connected to the power device; and a clutch device mounted between the first transmission device and the second transmission device, with the clutch device switchable between a coupling state when a resistance smaller than a torque output by the power device is encountered while the driving device is driving the fastener to rotate about the second axis and a disengagement state when a resistance larger than the torque output by the power device is encountered at a position while the driving device is driving the fastener to rotate about the second axis, wherein the clutch device includes a first clutch member mounted to the first transmission device, a second clutch member mounted to the second transmission device, and an elastic element abutting the first clutch member, with the first clutch member and the second clutch member disengageably engaged with each other; wherein the first clutch member comprises a center through-opening having a complementary shape to the first shape of the extension of the first transmission device, wherein the through-opening is configured to slidingly-receive the extension of the first transmission device; wherein the clutch device is configured to switch between the coupling state and the disengagement state at least by the first clutch member sliding along an outer portion of the extension of the first transmission device via the through-opening, generally along the first axis;

with the clutch device in the coupling state, the power device drives the second transmission device and the clutch device to drive the first transmission device to rotate about the first axis, and the driving device is rotated to continuously drive the fastener to rotate about the second axis without moving the body, with the clutch device in the disengagement state, the torque of the power device is not permitted to be transmitted through the second transmission device to the first transmission device, the body is manually rotated to overcome the resistance and to forcibly drive the fastener through the position via the driving device, wherein the clutch device returns to the coupling state after the fastener passes through the position, and wherein the driving device again drives the fastener to rotate about the second axis without moving the body, with the clutch device in the disengagement state, the first clutch member and the second clutch member repeatedly engage with and disengage from each other, the one of the first clutch member and the second clutch member compresses the elastic element, the body is manually rotated to overcome the resistance and to forcibly drive the fastener through the position via the driving device, and the clutch device returns to the coupling state under action of the elastic element after the fastener passes through the position; and wherein the elastic element is between the first transmission device and the first clutch member.

17. The electric ratchet wrench as claimed in claim 15, with the first clutch member further including a connection portion on an end face of the first clutch member opposite to the first transmission device, with the at least one first clutch portion provided on an inner periphery of the connection portion, with the second clutch member rotatably connected to the connection portion of the first clutch member, with the second clutch member including a through-hole, and with the at least one second clutch portion slideably received in the through-hole and disengageably engaged with the at least one first clutch portion.

18. The electric ratchet wrench as claimed in claim 17, with the body further including a compartment located in the second end of the body and a connection hole in communication with the compartment, with the Power device received in the compartment, with the first transmission device and the clutch device rotatably mounted in the connection hole, and with the second transmission device rotatably mounted in the compartment.

19. The electric ratchet wrench as claimed in claim 18, with the connection hole including a first section having a first inner diameter and a second section in communication with the first section and the compartment and having a second inner diameter larger than the first inner diameter, with the first transmission device rotatably mounted in the first section, with the clutch device rotatably mounted in the second section, and with the second transmission device rotatably mounted between the compartment and the second section of the connection hole.

20. The electric ratchet wrench as claimed in claim 19, with the driving device including a driving member rotatably mounted in the first end of the body and a first ring gear rotatably mounted to the driving member for driving the driving member to rotate, with the first ring gear including a side toothed portion on an end face thereof, with the first transmission member including a gear meshed with the side toothed portion of the first ring gear, with the body including a driving hole having an inner periphery with a toothed portion, with the driving device further including a second ring gear, a pawl device, and a direction switching device, with the second gear ring rotatably mounted to the driving member and spaced from the first ring gear, with the first ring gear further including an inner toothed portion on an inner periphery thereof, with the second ring gear including a side toothed portion on an end face thereof and an inner toothed portion on an inner periphery thereof, with the inner toothed portions of the first and second ring gears selectively engaged with the pawl device, with the side toothed portion of the second ring gear meshed with the gear of the first transmission member, with the pawl device including two primary pawls, a first secondary pawl, and a second secondary pawl, with each of the two primary pawls configured to selectively mesh with the toothed portion of the body, with the first secondary pawl configured to selectively mesh with the inner toothed portion of the first ring gear, with the second secondary pawl configured to selectively mesh with the inner toothed portion of the second ring gear, with the direction switching device including a direction switching rod extending through the driving member, with the direction switching rod pivotable relative to the driving member between two positions respectively corresponding to a driving direction and a non-driving direction, wherein when the direction switching rod pivots between the two positions, an engagement status between each of the two primary pawls and the toothed portion of the body and an engagement status between the first and second secondary pawls and the first and second ring gears are changed to provide a direction switching function.

* * * * *